US010527338B2

(12) United States Patent
Kim et al.

(10) Patent No.: US 10,527,338 B2
(45) Date of Patent: Jan. 7, 2020

(54) REFRIGERATOR

(71) Applicant: LG ELECTRONICS INC., Seoul (KR)

(72) Inventors: Kihwang Kim, Seoul (KR); Sunghee Kang, Seoul (KR); Donghyoung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 217 days.

(21) Appl. No.: 15/596,594

(22) Filed: May 16, 2017

(65) Prior Publication Data

US 2017/0343269 A1 Nov. 30, 2017

(30) Foreign Application Priority Data

May 26, 2016 (KR) ..... 10-2016-0065140

(51) Int. Cl.
*F25D 17/06* (2006.01)
*F25D 11/02* (2006.01)
(Continued)

(52) U.S. Cl.
CPC ..... *F25D 17/065* (2013.01); *F25D 11/02* (2013.01); *F25D 17/047* (2013.01); *F25D 21/08* (2013.01);
(Continued)

(58) Field of Classification Search
CPC ..... F25D 23/068; F25D 2317/063; F25D 2317/0665; F25D 2317/0628; F25D 2317/0667; F25D 17/067; F25D 17/08; F25D 17/065; F25D 11/02; F25D 17/04; F25D 17/06
See application file for complete search history.

(56) References Cited

U.S. PATENT DOCUMENTS 5,081,850 A * 1/1992 Wakatsuki ..... F25D 17/08 62/405
5,819,552 A * 10/1998 Lee ..... F25D 17/065 62/407
(Continued)

FOREIGN PATENT DOCUMENTS

CN 101975498 2/2011
CN 103256774 8/2013
(Continued)

OTHER PUBLICATIONS

Korean Office Action dated Jul. 17, 2017 issued in Application No. 10-2016-0065140.
(Continued)

*Primary Examiner* — Elizabeth J Martin
(74) *Attorney, Agent, or Firm* — KED & Associates LLP

(57) ABSTRACT

A refrigerator may include: a refrigerator compartment, a convertible compartment, an evaporator disposed in the convertible compartment; and a grill pan assembly forming a space where the evaporator is disposed by dividing the inside of the convertible compartment. The grill pan assembly may include an insulating member, a convertible compartment fan, a refrigerator compartment fan, and an opening device formed at the insulating member from the convertible compartment channel to the refrigerator compartment channel.

27 Claims, 28 Drawing Sheets

(51) Int. Cl.

| | |
|---|---|
| ***F25D 17/04*** | (2006.01) |
| ***F25D 21/08*** | (2006.01) |
| ***F25D 21/14*** | (2006.01) |
| ***F25D 23/06*** | (2006.01) |

(52) U.S. Cl.
CPC ..... *F25D 21/14* (2013.01); *F25D 23/068* (2013.01); *F25D 2317/063* (2013.01); *F25D 2317/0665* (2013.01); *F25D 2317/0682* (2013.01); *F25D 2400/16* (2013.01); *F25D 2400/361* (2013.01)

(56) References Cited

U.S. PATENT DOCUMENTS

| | | | | |
|---|---|---|---|---|
| 6,381,982 | B1 | 5/2002 | Kim | |
| 8,191,382 | B2 * | 6/2012 | Lim | F25D 11/022 62/441 |
| 2008/0202149 | A1 * | 8/2008 | Lim | F25D 17/062 62/407 |
| 2016/0273823 | A1 * | 9/2016 | Cho | F25D 17/067 |

FOREIGN PATENT DOCUMENTS

| | | |
|---|---|---|
| KR | 10-1999-0031033 | 5/1999 |
| KR | 10-2010-0076089 | 7/2010 |
| KR | 10-2010-0097928 | 9/2010 |
| WO | WO 02/16843 A1 | 2/2002 |

OTHER PUBLICATIONS

Extended European Search Report issued in application 17172775.3 dated Oct. 24, 2017.
Chinese Office Action dated May 7, 2019 issued in Application No. 201710368534.3 (with English Translation).

* cited by examiner

REFRIGERATOR

CROSS-REFERENCE TO RELATED APPLICATION

This application claims priority under 35 U.S.C. § 119 and 35 U.S.C. § 365 from Korean Patent Application No. 10-2016-0065140, filed May 26, 2016, the entire subject matter of which is hereby incorporated by reference.

BACKGROUND

1. Field

Embodiments may relate to a refrigerator.

2. Background

A refrigerator is an appliance that can keep food at low temperatures in internal spaces that are opened/closed by doors. Refrigerators may be configured to keep food in an optimal status by cooling an inside of the storage space, and using cold air produced by heat exchange with a refrigerant circulating in a refrigeration cycle.

Refrigerators may be configured to maintain an internal temperature at predetermined levels to keep stored food in the optimal status for the characteristics of use. The inside of refrigerators should be able to be sealed and cooled through supply of cold air using the refrigeration cycle in order to maintain set temperatures.

A top mount refrigerator having a freezer compartment at a top and an evaporator inside the freezer compartment is disclosed in Korean Patent Application Publication No. 10-2010-0076089, the subject matter of which is incorporated herein by reference. In the refrigerator, cold air produced by an evaporator can be supplied to a refrigerator compartment and a freezer compartment by a fan and a damper, and a heater may be disposed in the freezer compartment so that the freezer compartment can be used as a convertible compartment.

BRIEF DESCRIPTION OF THE DRAWINGS

Arrangements and/or embodiments may be described in detail with reference to the following drawings in which like reference numerals refer to like elements and wherein.

DETAILED DESCRIPTION

Arrangements and/or embodiments may be described in detail with reference to drawings. However, embodiments should not be construed as being limited to the embodiments as other embodiments may be easily proposed by adding, changing, and removing other components.

A top mount refrigerator with a freezer compartment over a refrigerator compartment may be exemplified in embodiments for easy describing and understanding, but it should be understood that embodiments may be applied to any type of refrigerator including one evaporator and two fans.

Figure 1:
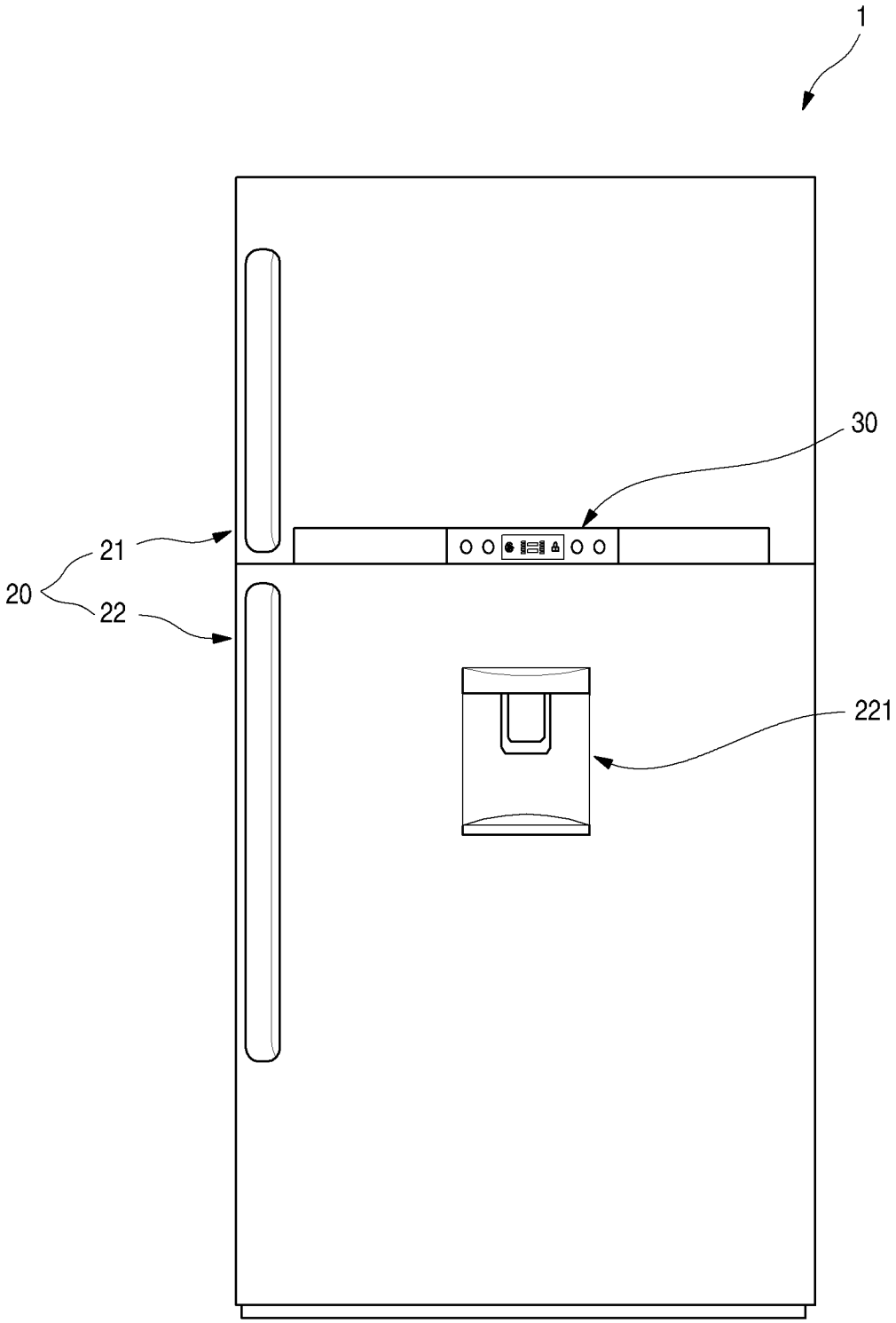
FIG. 1 is a front view of a refrigerator according to an example embodiment.
Figure 2:
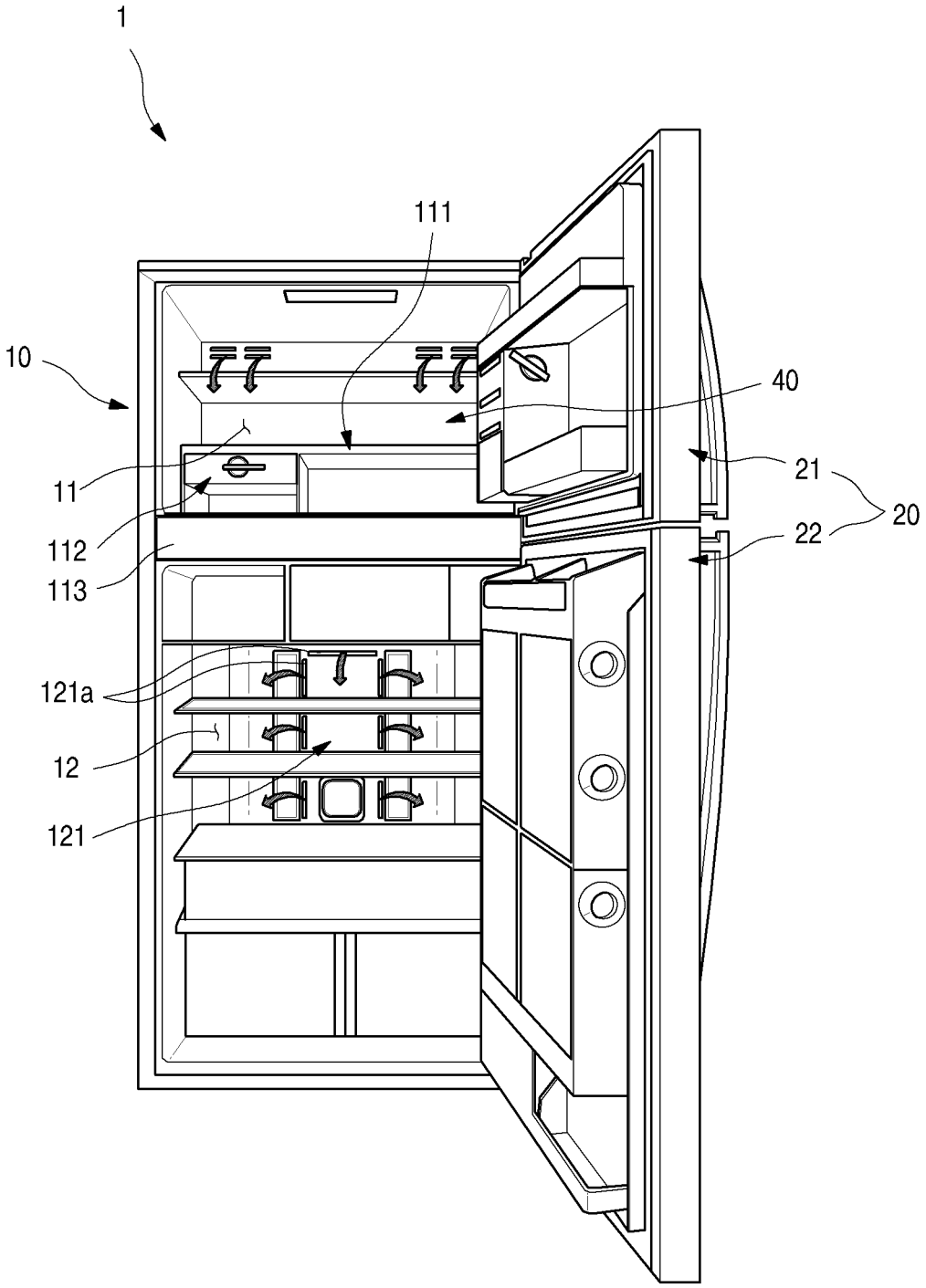
FIG. 2 is a view of the refrigerator with doors open.

FIG. 1 is a front view of a refrigerator according to an example embodiment. FIG. 2 is a view of the refrigerator with doors open. Other embodiments and configurations may also be provided.

As shown, a refrigerator 1 may include a cabinet 10 and a door 20 opening/closing the storage space of the cabinet 10.

The cabinet 10 may be vertically divided by a barrier 13 and may include a convertible compartment 11 (at a top) and a refrigerator compartment 12 (at a bottom). The convertible compartment may be used as a freezer compartment, and it may be used as the refrigerator compartment when a user sets the temperature as a refrigerator temperature. Accordingly, the convertible compartment 11 may also be referred to as a freezer compartment. The convertible compartment 11 may be referred to as a first storage space, and the refrigerator compartment 12 may be referred to as a second storage space.

An evaporator 15 (FIG. 4) may be at a rear portion inside the convertible compartment 11, and cold air that is produced by the evaporator 15 may be supplied to the convertible compartment 11 and the refrigerator compartment 12, whereby the convertible compartment 11 and the refrigerator compartment 12 can be cooled.

In the convertible compartment 11, a plurality of storage components including a shelve 111 (and/or shelves) and a basket may be disposed, and an ice maker 112 for making ice may be separately disposed.

The rear side of the convertible compartment 11 may be formed (or provided) by a grill pan assembly 40. The grill pan assembly 40 may separate (or divide) the internal space of the convertible compartment 11 into front and rear parts. That is, the grill pan assembly 40 may separate the inside of the convertible compartment 11 such that a first space (or front space) may be used for storing food and a second space (or rear space) may be used to dispose the evaporator 15. The grill pan assembly 40 may have a plurality of exhaust vents 53 and 55 (FIG. 6) for discharging cold air into the convertible compartment 11.

A plurality of storage components including a plurality of shelves and drawers may be disposed in the refrigerator compartment 12 and a multi-duct 121 may be disposed on a rear side inside the refrigerator compartment 12. The multi-duct 121 may communicate with the rear space where the evaporator 15 is disposed in the convertible compartment 11, and the multi-duct 121 may supply cold air into the refrigerator compartment 12. The multi-duct 121 may be vertically elongated and may have a plurality of refrigerator compartment exhaust vents 121*a* such that cold air can be supplied into the refrigerator compartment 12.

A machine room 14 (for providing various electrical parts including a compressor 141 and a condenser) may be disposed at a rear lower end of the cabinet 10.

The door 20 may be composed of a convertible compartment door 21 and a refrigerator compartment door 22 for opening/closing the convertible compartment 11 and the refrigerator compartment 12, respectively. The convertible compartment door 21 and the refrigerator compartment door 22 may be rotatably coupled to the cabinet 10, and can open and close the convertible compartment 11 and the refrigerator compartment 12 by rotating. Door baskets (for food) may be mounted on the rear sides of the convertible compartment door 21 and the refrigerator compartment door 22.

A dispenser 221 may be disposed on a front side of the refrigerator compartment door 22. The dispenser 221 can be supplied with water from a water tank in the refrigerator or a water pipe directly connected to the refrigerator such that water can be taken out from the outside.

A display 30 (FIG. 3) may be disposed on the front side of the convertible compartment door 21, for example. The display 30 may be positioned at the lower end of the convertible compartment door 21 so that a user can easily check and operate the display 30.

Figure 3:
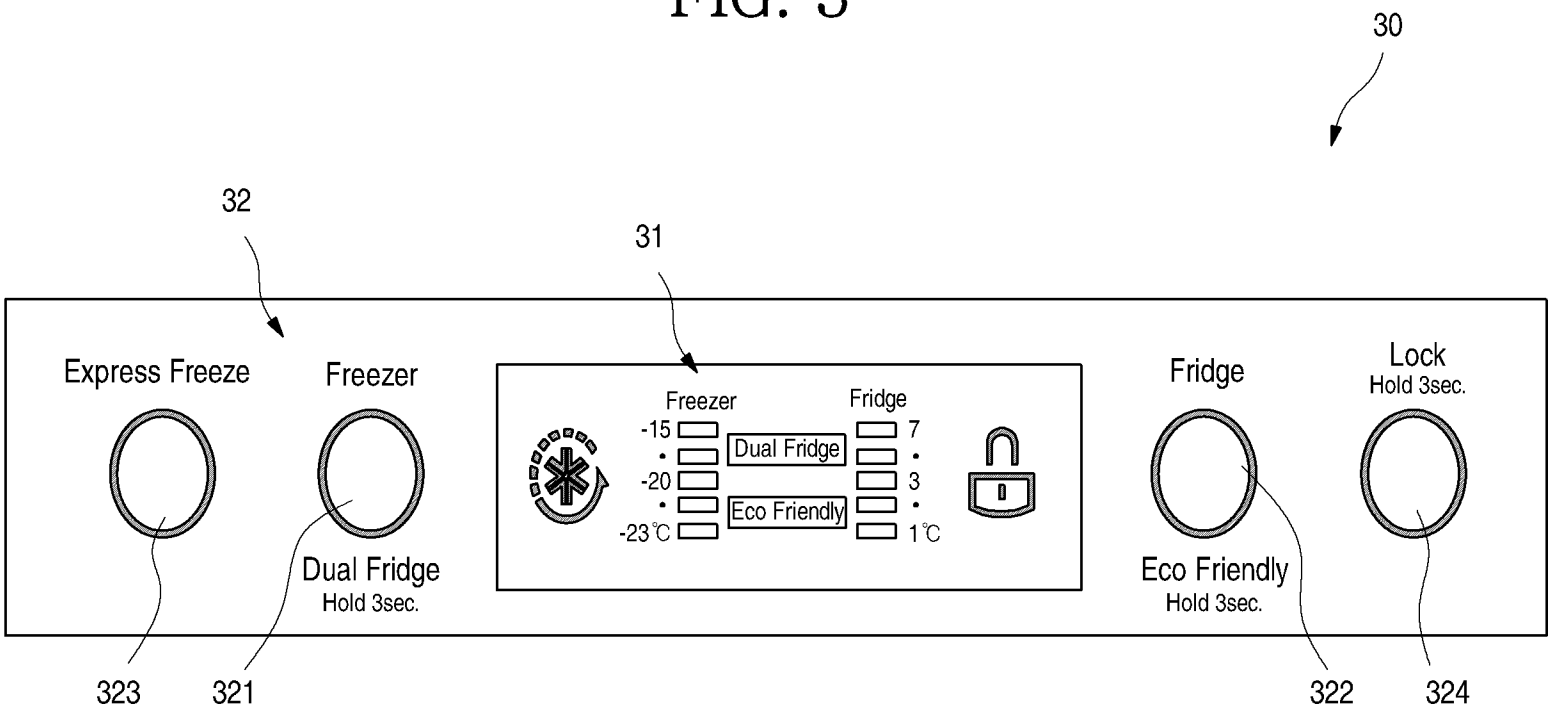
FIG. 3 is a view showing a display according to an example embodiment.

FIG. 3 is a view showing a display according to an example embodiment. Other embodiments and configurations may also be provided.

The display 30 may include an operation section 32 for operating the refrigerator 1 and a display section 31 for displaying an operation state and a set state of the refrigerator.

The display section 31 may be provided at a center of the display 30, and may be a screen that can display various items of information. Set temperatures (or setting temperatures) of the convertible compartment 11 and the refrigerator compartment 12, a locking state of the operation section 32, a set state of an express freeze mode or an eco-mode, and a conversion state of the convertible compartment 11 may be displayed on the display section 31.

The operation section 32 may have various buttons (or keys) and may be disposed at both sides of the display section 31. The operation section 32 may include a freezer button 321 for controlling a temperature of the convertible compartment 11, a refrigerator compartment button 322 for controlling a temperature of the refrigerator compartment 12, an express freeze button 323 for rapidly cooling the convertible compartment 11, and a lock button 324 for preventing unexpected operation of the display 30.

When the freezer button 321 is pressed for a predetermined time or more, the temperature of the convertible compartment 11 may be set at the temperature of the refrigerator compartment 12, and when the freezer button 321 is pressed again for the predetermined time or more, the temperature may be set at the temperature of the freezer compartment. That is, the temperature of the convertible compartment 11 may be changed to a freezer temperature or a refrigerator temperature by operating the freezer button 321.

When the refrigerator compartment button 322 is pressed for a predetermined time or more, the internal temperature is maintained at a set temperature, in which the set temperature is set a little higher than the previous temperature so that power consumption can be reduced.

Figure 4:
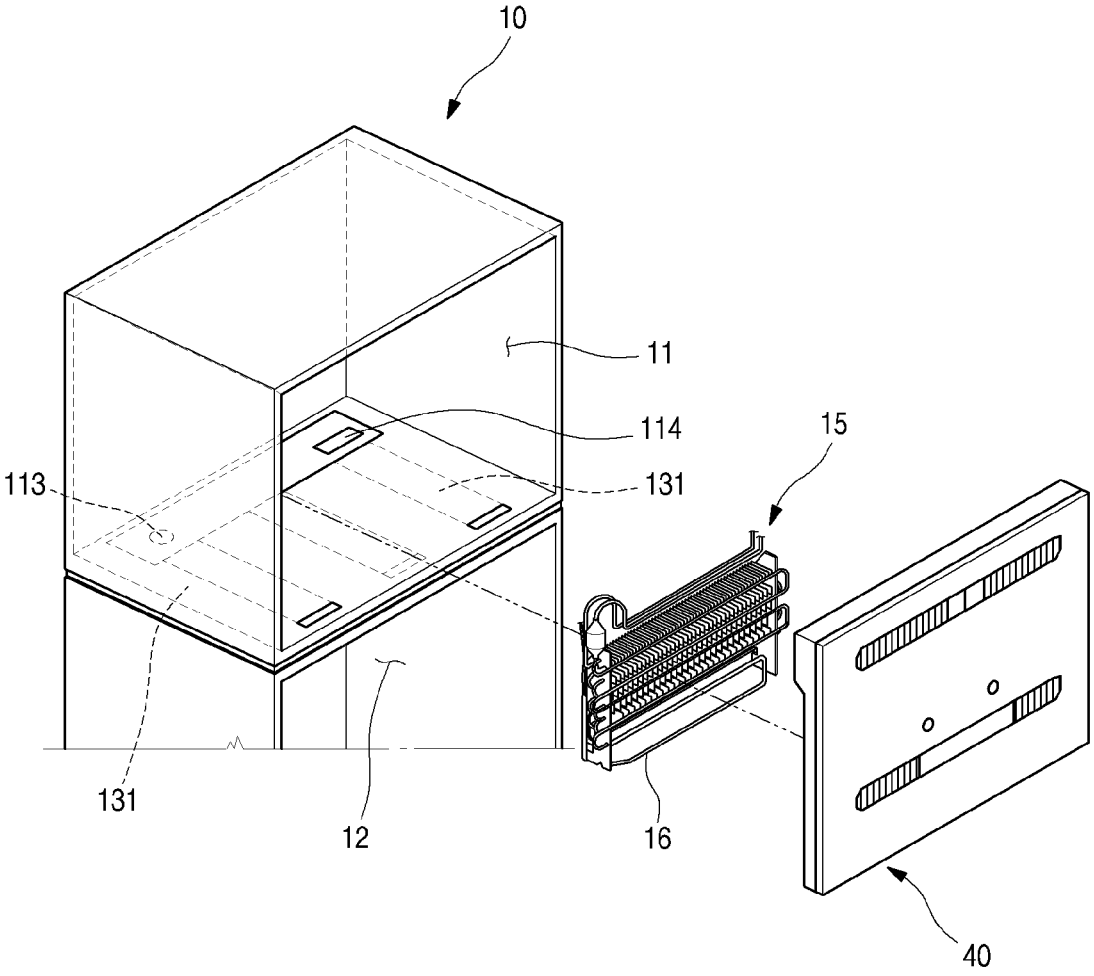
FIG. 4 is an exploded perspective view showing an internal structure of a convertible compartment of the refrigerator.
Figure 5:
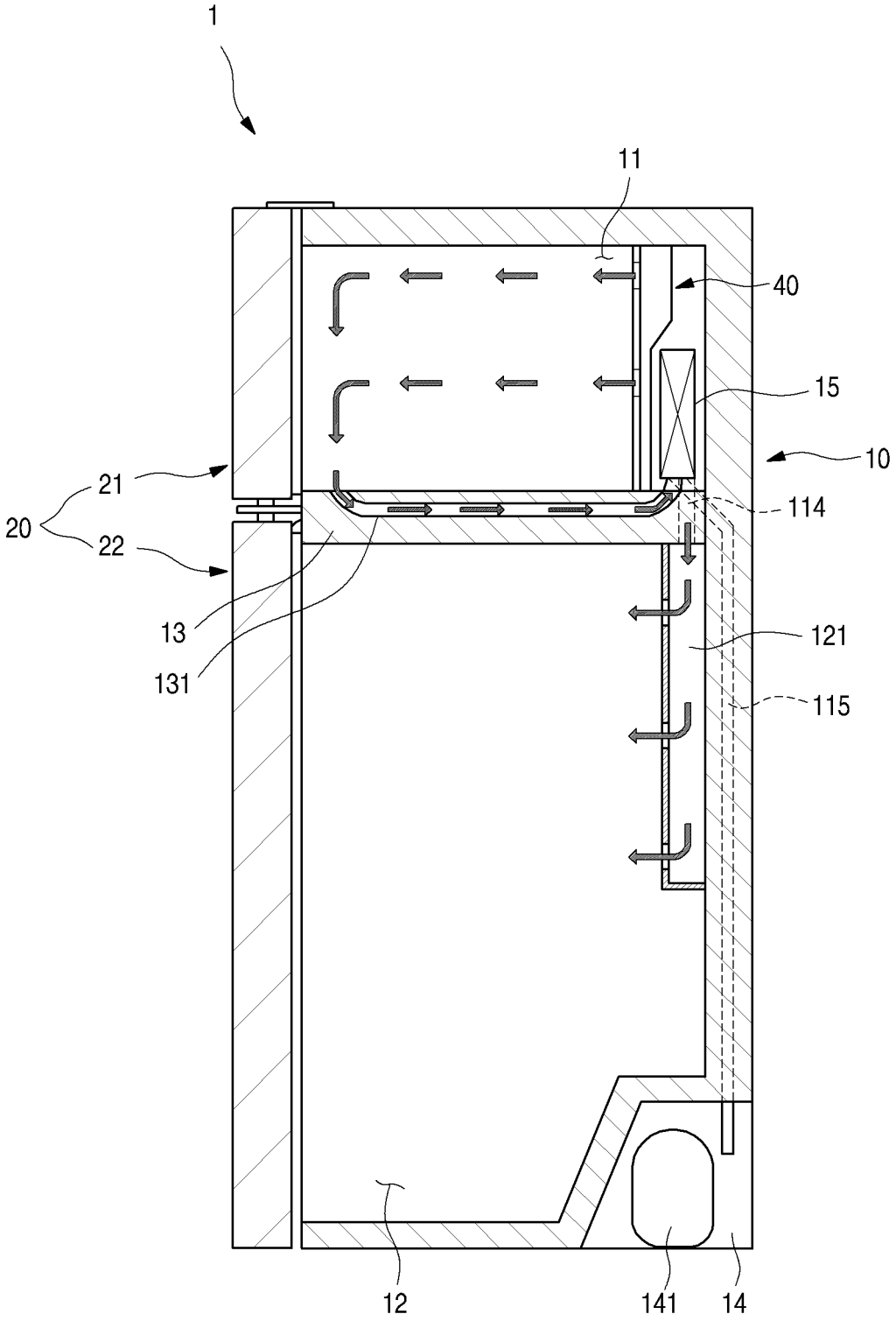
FIG. 5 is a view schematically showing airflow in the refrigerator.

FIG. 4 is an exploded perspective view showing an internal structure of a convertible compartment of a refrigerator. FIG. 5 is a view schematically showing airflow in the refrigerator. Other embodiments and configurations may also be provided.

As shown, the grill pan assembly 40 is disposed ahead of the rear side of the convertible compartment 11. The grill pan assembly 40 may define a space, where the evaporator 15 can be disposed, at the rear portion inside the convertible compartment 11, and the grill pan assembly 40 may form channels for the cold air produced by the evaporator 15 to be supplied to the convertible compartment 11 and the refrigerator compartment 12.

The evaporator 15 may be disposed in the space behind the grill pan assembly 40 and may be fixed to the bottom inside of the convertible compartment 11. A defrost heater 16 may be part of the evaporator 15 (or may be separate from the evaporator 15). The defrost heater 16 may remove ice in the evaporator 15 and may be turned on/off to remove ice at a predetermined cycle. The defrost heater 16 may operate to quickly increase the temperature of the convertible compartment 11, when the temperature of the convertible compartment 11 is set at the temperature of the refrigerator compartment 12.

A defrost water exit 113 and a refrigerator compartment supply duct 114 may be provided at the bottom inside of the convertible compartment 11 on which the evaporator 15 is disposed. The defrost water exit 113 may be provided at the bottom inside of the convertible compartment 11 and may extend to connect to a defrost water tube 115 (FIG. 5) so that defrost water that is produced in a defrost operation may be sent to a drain pan (not shown) in the machine room 14. A convertible compartment return duct 131 may be provided in the bottom of the convertible compartment 11 to form a channel such that air in the convertible compartment 11 can flow back into the evaporator 15.

The refrigerator compartment supply duct 114, which is formed to supply cold air into the refrigerator compartment 12 from the evaporator 15, may be open to connect to an insulating duct 80 (FIG. 6) of the grill pan assembly 40. The insulating duct 80 may be connected to the multi-duct 121 on the inner side of the refrigerator compartment 12 so cold air may be uniformly supplied into the refrigerator compartment 12 through the multi-duct 121.

A refrigerator compartment temperature sensor 122 (FIG. 22) may be disposed at the multi-duct 121 or at a side in the refrigerator compartment 12 so the refrigerator compartment 12 can be controlled to be maintained at a set temperature by the refrigerator compartment temperature sensor 122.

The grill pan assembly 40 may block heat transfer by blocking the evaporator 15 ahead of the evaporator 15 such that chill (or chilled air) from the evaporator 15 is not transmitted to the convertible compartment 11 though radiation and conduction. The cold air from the evaporator 15 can be supplied into the refrigerator compartment 12 and the convertible compartment 11 by two fans 41 and 42 (FIG. 6) disposed in the grill pan assembly 40 (or at the grill pan assembly 40) and cold air channels formed in the grill pan assembly 40.

Figure 6:
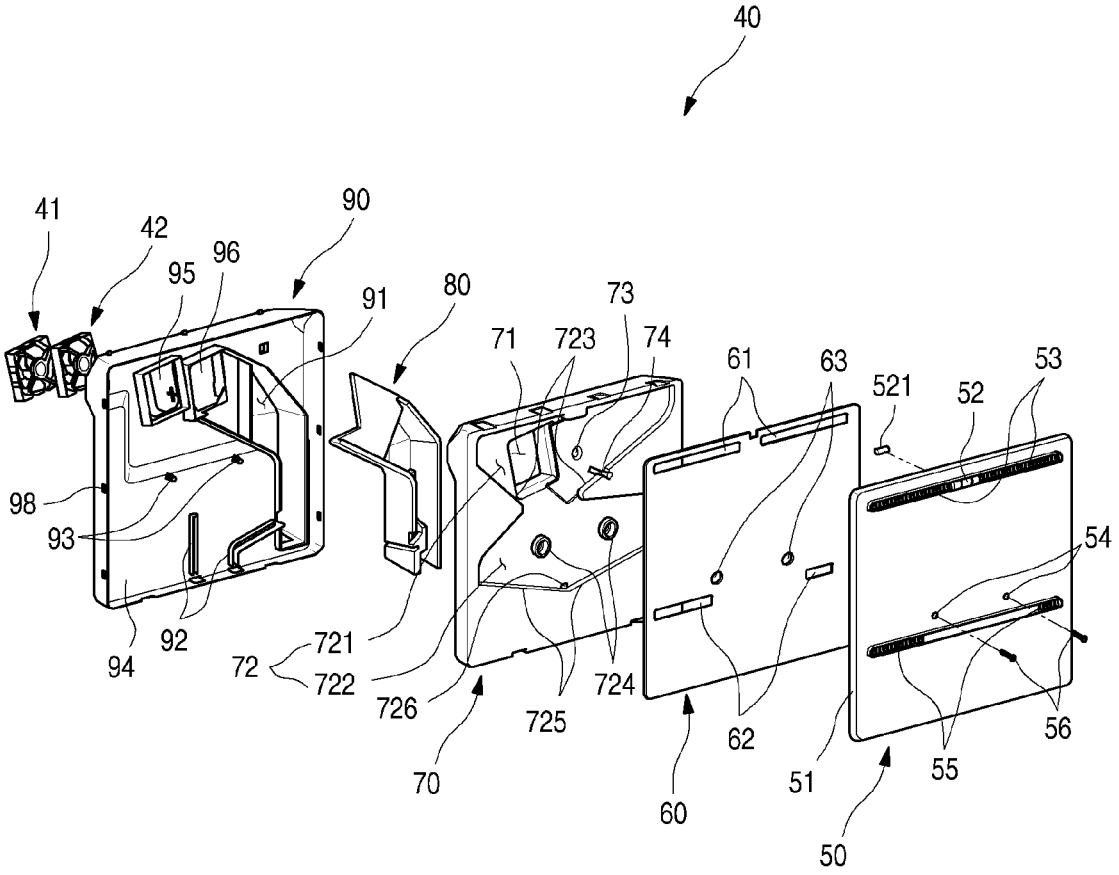
FIG. 6 is a front exploded perspective view of a grill pan assembly according to an example embodiment.
Figure 7:
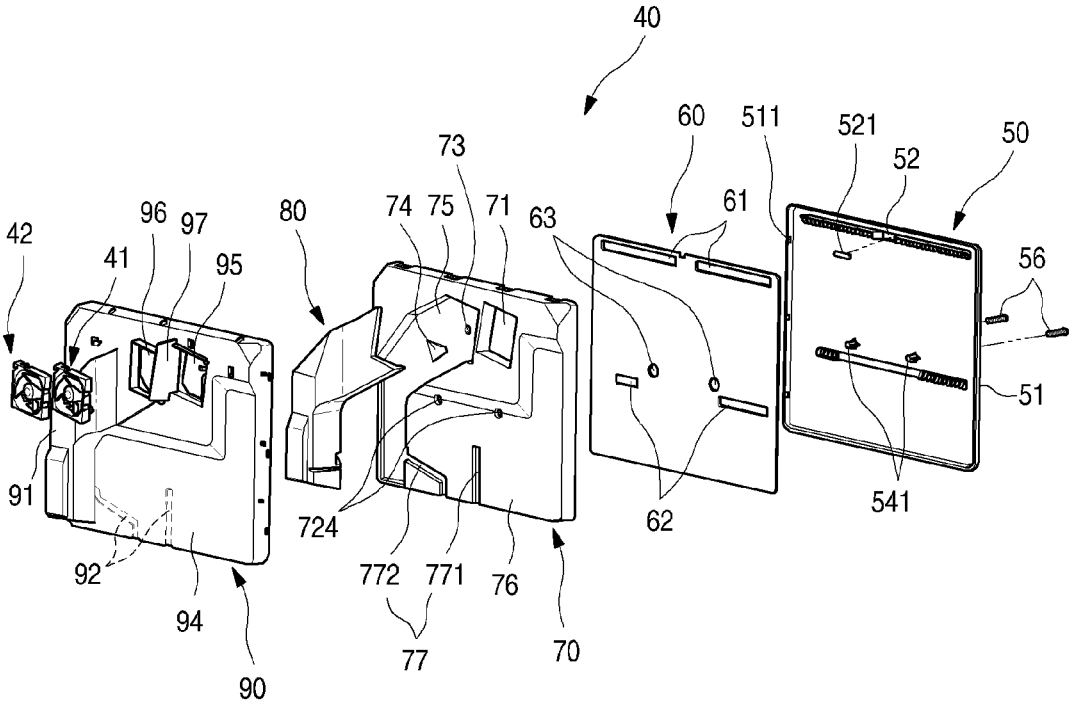
FIG. 7 is a rear exploded perspective view of the grill pan assembly.

FIG. 6 is a front exploded perspective view of a grill pan assembly according to an example embodiment. FIG. 7 is a rear exploded perspective view of the grill pan assembly. Other embodiments and configurations may also be provided.

As shown, the grill pan assembly 40 may divide (or separate) the inside of the convertible compartment 11. The grill pan assembly 40 may include a grill pan 50, an insulating sheet 60, an insulating member 70, an insulating duct 80, and a shroud 90, for example. Other features may also be provided. The insulating member may hereafter be referred to as an insulating structure or insulating support structure.

The grill pan 50 may form the rear wall (or other wall) of the convertible compartment 11. The grill pan 50 may be made of plastic through injection molding. The grill pan 50 may be formed in a rectangular plate shape, and may have a pan edge 51 (which is rounded) for coupling to the shroud 90.

Coupling portions 511 that are coupled to coupling hooks 98 formed around the edge of the shroud 90 may be formed at the pan edge 51. Accordingly, by combining (or connecting) the shroud 90 and the grill pan 50, the insulating sheet 60, the insulating member 70, and the insulating duct 80 can be combined in the grill pan assembly 40.

A sensor mount 52 may be formed at a center of the upper portion of the grill pan 50. A convertible compartment sensor 521 may be disposed in the sensor mount 52 so temperature inside the convertible compartment 11 may be measured. The temperature measured by the convertible compartment sensor 521 may be used as data for determining whether to supply cold air into the convertible compartment 11.

Upper pan exits 53 may be formed at both sides of the sensor mount 52. The upper pan exits 53 may be formed by grills laterally thinly elongated at an upper portion inside the convertible compartment 11 such that cold air may be uniformly supplied into the convertible compartment 11.

Fasteners holes 54 may be formed at a center portion of the grill pan 50. The fastener holes 54 may be formed in pairs at left and right sides and insertion bosses 541 extending rearward may be formed behind the fastener holes 54. The fasteners 56 may pass through the insertion bosses 541 such that the grill pan 50, the insulating sheet 60, and the insulating member 70 can be combined (or connected) with the shroud 90. Accordingly, the fasteners 56 may be inserted in the fastener holes 54 and fixed to the shroud 90 through the insertion bosses 541.

The positions of the fastener holes 54 may be determined such that the fastener holes 54 are positioned in a convertible compartment channel 72 (to be described below). A height of the fastener holes 54 may be determined to correspond to a height of the shelve in the convertible compartment 11. Accordingly, when the shelve 111 is mounted in the convertible compartment 11, the fastener holes 54 may be covered by the rear end of the shelve 111, whereby the fastener holes 54 may be prevented from being exposed when the door is opened.

Lower pan exits 55 may be formed under the fastener holes 54. The lower pan exits 55 may be formed in a grill shape and may be positioned close to at least one of both left and right sides. That is, the lower pan exits 55 may be provided at both sides corresponding to a position of the ice maker 112 (in the convertible compartment 11) such that cold air can be smoothly supplied into the ice maker 112.

The cold air discharged into the convertible compartment 11 flows down, so an area of the upper pan exits 53 may be larger (or greater) than the area of the lower pan exits 55 to remove non-uniform distribution of cold air in the convertible compartment 11, and the areas of the upper pan exits 53 and the lower pan exits 55 may be determined at a ratio of substantially 7:3.

The insulating sheet 60 may prevent chill of the cold air flowing in the grill pan assembly 40 from directly transferring to the convertible compartment 11 through radiation and conduction. The insulating sheet 60 may be disposed on an inner side of the grill pan assembly 40. The insulating sheet 60 may have a rectangular plate shape with a size corresponding to the front side of the grill pan assembly 40, and the insulating sheet 60 may be in close contact with the inner side of the grill pan assembly 40.

The insulating sheet 60 may be made of thin PSP (Polystyrene Paper). That is, the insulating sheet 60 may have a structural characteristic of being formed in a plate shape that is thinner than the insulating member 70, so it can be made of PSP, which is easy to form in a thin sheet shape, to be disposed in the space behind the grill pan 50.

The insulating sheet 60 may be attached to the grill pan 50 such that the insulating sheet 60 can insulate the entire front side of the grill pan assembly 40. Accordingly, when the convertible compartment 11 is set at a refrigerator temperature, dew condensation through the insulating sheet 60 may be prevented or reduced even if a temperature difference is generated between the inside of the convertible compartment 11 and the front side of the grill pan 50 due to a decrease in temperature of the front side of the grill pan 50.

The insulating sheet 60 may have upper sheet holes 61 and lower sheet holes 62 that have sizes and positions corresponding to the upper pan exits 53 and the lower pan exits 55, respectively. The insulating sheet 60 may further have sheet boss holes 63 through which the insertion bosses 541 pass.

The insulating member 70 (or insulating structure) may be disposed behind the insulating sheet 60. The insulating member 70 may prevent chill of the cold air from the evaporator 15 from transferring to the convertible compartment 11 through radiation and conduction. The insulating member 70 may form channels for cold air to separately flow into the convertible compartment 11 and the refrigerator compartment 12.

The insulating member 70 may be made of EPS (Expanded Polystyrene) that is easy to form and has excellent insulation ability. The insulating member 70 may be disposed inside the grill pan 50 and the shroud 90. The edge of the insulating member 70 may come in close contact with the inner sides of the grill pan 50 and the shroud 90. The insulating member 70 can be fixed in the grill pan assembly 40 by combining the grill pan 50 and the shroud 90, and securing the fasteners 56.

An insulating member exit 71 may be provided through the insulating member 70 at a position corresponding to the convertible compartment fan 41. The insulating member exit 71 may have a rectangular shape in which the convertible compartment fan 41 can be mounted. The convertible compartment channel 72 may be on the front side of the insulating member 70.

The convertible compartment channel 72 may be recessed inward and may be composed of an upper section 721 at an upper portion of the insulating member 70 and a lower section 722 under the upper section 721. The upper section 721 may be laterally elongated at the upper portion of the insulating member 70 such that the width decreases as it goes downward. That is, first inclined portions 723 may be formed at both sides of the upper section 721. The first inclined portions 723 may allow frost or frost water produced in the convertible compartment channel 72 to flow downward along the inclined surfaces.

The upper pan exits 53 (of the grill pan 50) may be positioned inside the upper section 721 (of the convertible compartment channel 72). The insulating structure (or insulating member 70) may include an air guide opening (or opening). The air guide opening may be a negative pressure compensation hole and/or an anti-backflow portion. For example, a negative pressure compensation hole 73 and an anti-backflow portion 74 (to be described below) together with the insulating member exit 71 may be provided inside the upper section 721.

Accordingly, cold air flowing in the convertible compartment channel 72 and moving down can be partially restricted by the first inclined portions 723 such that a larger amount of cold air may be induced to be intensively discharged in comparison to the upper pan exits 53.

The lower section 722 (of the convertible compartment channel 72) may be connected to the open lower end of the upper section 721. The lower section 722 may have a predetermined width so that the lower pan exits 55 can be positioned therein. The lower section 722 may be increased in width as it goes down from the top that communicates with the upper section 721.

Supporting bosses 724 may be formed inside the lower section 722. The supporting bosses 724, which are provided to support the insulating sheet 60, may protrude in pairs inside the lower section 722. The support bosses 724 are hollow such that shroud coupling portions 93 (to be described below) can be inserted therein. Accordingly, the fasteners 56 can be secured in the shroud coupling portions 93.

The supporting bosses 724 may have the same height as the front side of the insulating member 70 (i.e., the outer side of the convertible compartment channel 72). Accordingly, the supporting bosses 724 and the front side of the insulating member 70 can support the insulating sheet 60, and the space of the convertible compartment channel 72 is spaced from the insulating sheet 60 such that a space for flow of cold air can be maintained.

Second inclined portions 725 may be provided at the lower end of the lower section 722. The second inclined portions 725 may be provided at both left and right sides. The joining (or joint) of the second inclined portions 725 at both sides is a center of the lower section 722, which is the lowest point. Accordingly, water flowing into the lower section 722 may flow toward the lower end center of the lower section 722.

A water discharge hole 726 may be provided through the insulating member 70 at the lower end center of the lower section 722. The water discharge hole 726 may allow water in the convertible compartment channel 72 to be discharged out of the grill pan assembly 40 through the insulating member 70 and a first water discharge guide 771 on the rear side of the insulating member 70.

A refrigerator compartment channel 75 may be provided on the rear side of the insulating member 70. The refrigerator compartment channel 75 can form an independent channel for cold air to flow into the refrigerator compartment by being fitted on the insulating duct 80 and guide the cold air from the evaporator 15 into the refrigerator compartment 12. A negative pressure compensation hole 73 and an anti-backflow portion 74 (to be described below) may be provided at the refrigerator compartment channel 75.

On the rear side of the insulating member 70, a concave evaporator seat 76 may be provided at a side of the lower portion corresponding to the position of the evaporator 15. A water discharge guide 77 may be provided inside the evaporator seat 76.

The water discharge guide 77 may be concaved such that defrost water or condensate water in the grill pan assembly 40 can be discharged. The water discharge guide 77 may be composed of the first water discharge guide 771 that communicates with the convertible compartment channel 72 and a second water discharge guide 772 that communicates with the refrigerator compartment channel 75.

The first water discharge guide 771 may communicate with the water discharge hole 726 at the upper end, and the first water discharger guide 771 may vertically extend to the lower end of the insulating member 70. Accordingly, water flowing into the water discharge hole 726 can be discharged to the lower end of the grill pan assembly 40 through a shortest distance.

The second water discharge guide 772 may have an upper end connected to a side of the refrigerator compartment channel 75 and a lower end being open at the lower end of the insulating member 70. The second water discharge guide 772 may be at least partially inclined such that the water flowing along a side of the refrigerator compartment channel 75 can be discharged to the lower end of the grill pan assembly 40 through the second water discharge guide 772.

The first water discharge guide 771 and the second water discharge guide 772 may be independently provided. Accordingly, cold air in the convertible compartment 11 may be prevented from flowing and freezing in the second water discharge guide 772.

A drain member 116 (FIG. 19) for collecting water discharged from the first water discharge guide 771 and the second water discharge guide 772 may be disposed under the grill pan assembly 40. The drain member 116 may be connected to the defrost water tube 115 and may discharge collected water to the machine room 14.

The insulating duct 80 may be made of EPS, which is the same as the insulating member 70, and the insulating duct 80 may have a shape corresponding to the refrigerator compartment channel 75. The insulating duct 80 may be mounted at the refrigerator compartment channel 75.

The insulating duct 80 may have an open front side and may be fixed to the refrigerator compartment channel 75 at the front end, thereby forming a space through which cold air can flow. When the insulating duct 80 is mounted at the refrigerator compartment channel 75, the upper end of the insulating duct 80 and the upper end of the refrigerator compartment channel 75 may form a rectangular hole-shaped refrigerator compartment inlet 78. When the refrigerator compartment fan 42 is mounted, the refrigerator compartment inlet 78 may be a passage through which cold air flows inside through the refrigerator compartment fan 42.

The lower end of the insulating duct 80 is open, and when the grill pan assembly 40 is mounted, the lower end of the insulating duct 80 may be connected to the refrigerator compartment supply duct 114. Accordingly, the insulating duct 80 may form a channel between the refrigerator compartment fan 42 and the refrigerator compartment supply duct 114.

The shroud 90 may form the rear side of the grill pan assembly 40. The shroud 90 may be made of plastic through injection molding. The shroud 90 may be formed in a shape corresponding to the shape of the insulating member 70 and the insulating duct 80. That is, the insulating duct 80 and the insulating member 70 may be received inside the shroud 90, and may be fixed in close contact with each other.

On the front side of the shroud 90, a recessed insulating duct seat 91 may be formed at a position corresponding to the insulating duct 80 and guide ribs 92 supporting the inner side of the water discharge guide 77 may be formed at positions corresponding to the water discharge guide 77. The shroud coupling portions 93 may be formed at positions corresponding to the supporting bosses 724. The fasteners 56 may be secured in the shroud coupling portions 93.

A recessed evaporator seat 94 may be formed at the lower portion on the rear side of the shroud 90 (i.e., at the lower portion corresponding to the evaporator seat 76 of the shroud 90). The evaporator 15 may be disposed in the evaporator seat 94. The upper portion of the rear side, which corresponds to the portion over the evaporator 15, of the shroud 90 may protrude such that the upper portion and the lower portion of the rear side of the shroud 90 may be stepped.

A convertible compartment fan mount 95 and a refrigerator compartment fan mount 96 may be formed at the upper portion of the shroud 90. The convertible compartment fan mount 95 and the refrigerator compartment fan mount 96 may be disposed at both sides from the upper center portion of the shroud 90. Accordingly, cold air from the evaporator 15 may uniformly flow to the convertible compartment fan 41 and the refrigerator compartment fan 42.

The convertible compartment fan mount 95 may be open at a position corresponding to the insulating member exit 71. Accordingly, when the convertible compartment fan 41 mounted in the convertible compartment fan mount 95 is operated, the cold air from the evaporator 15 passes through the convertible compartment fan mount 95 and the insulating member exit 71 and then can be supplied into the convertible compartment 11 through the convertible compartment channel 72, and the upper pan exits 53 and the lower pan exits 55 of the grill pan 50.

The refrigerator compartment fan mount 96 may be open at the convertible compartment fan mount 95. The refrigerator compartment fan mount 96 may be formed at a position corresponding to the refrigerator compartment inlet 78. Accordingly, when the refrigerator compartment fan 42 mounted in the refrigerator compartment fan mount 96 is operated, cold air from the evaporator 15 passes through the refrigerator compartment fan mount 96 and the refrigerator compartment inlet 78 and then can be supplied into the refrigerator compartment 12 sequentially through the insulating duct 80, the refrigerator compartment supply duct 114, and the multi-duct 121.

A dividing wall 97 (FIG. 7) may be provided between the convertible compartment fan mount 95 and the refrigerator compartment fan mount 96. The dividing wall 97 may protrude rearward and may extend outward further than the upper ends and the lower ends of the convertible compartment fan mount 95 and the refrigerator compartment fan mount 96. The dividing wall 97 may protrude a predetermined height such that the convertible compartment fan 41 and the refrigerator compartment fan 42 do not interfere with flow from them when they are operated. Accordingly, the dividing wall 97 may prevent air that flows when the refrigerator compartment fan 42 or the convertible compartment fan 41 is operated from flowing into the adjacent fan mount 95 or 96 or prevent air that flows when the fans are both operated from interfering with each other.

The convertible compartment fan mount 95 and the refrigerator compartment fan mount 96 may be provided in a rectangular hole shape corresponding to shapes of the box fan-shaped convertible compartment fan 41 and refrigerator compartment fan 42. Seats 951 and 961 for seating the convertible compartment fan 41 and the refrigerator compartment fan 42 may be provided inside the convertible compartment fan mount 95 and the refrigerator compartment fan mount 96, respectively.

The seats 951 and 961 may support edges of the convertible compartment fan 41 and the refrigerator compartment fan 42 such that the convertible compartment fan 41 and the refrigerator compartment fan 42 are inclined. The seats 951 and 961 may further protrude rearward at the upper portions more than the lower portions. Accordingly, when the convertible compartment fan 41 and the refrigerator compartment fan 42 are mounted, the convertible compartment fan 41 and the refrigerator compartment fan 42 are inclined such that the upper ends further protrude rearward more than the lower ends such that water condensed on the convertible compartment fan 41 and the refrigerator compartment fan 42 can flow down along the slopes.

The convertible compartment fan mount 95 and the refrigerator compartment fan mount 96 may be inclined in the opposite direction to the rotational direction of blades of the convertible compartment fan 41 and refrigerator compartment fan 42, respectively. That is, bottoms of the convertible compartment fan mount 95 and the refrigerator compartment fan mount 96 may be inclined at about 20° from the lower end of the grill pan 50. Accordingly, the convertible compartment fan 41 and the refrigerator compartment fan 42 may also be mounted at an angle such that the water over the convertible compartment fan 41 and the refrigerator compartment fan 42 or the convertible compartment fan mount 95 and the refrigerator compartment fan mount 96 can flow down along the slopes without collecting.

Vibration noise by the convertible compartment fan 41 and the refrigerator compartment fan 42 may be reduced by attaching a vibration reduction member such as Foam PU around the convertible compartment fan 41 and the refrigerator compartment fan 42, when the convertible compartment fan 41 and the refrigerator compartment fan 42 are mounted.

The convertible compartment fan 41 and the refrigerator compartment fan 42 may be compact box type fans. Accordingly, an increase in thickness of the grill pan assembly 40 may be prevented and internal capacity may be maximized.

The convertible compartment fan 41 and the refrigerator compartment fan 42 may be the same in size and shape, but when the convertible compartment 11 is maintained at a freezer compartment, the convertible compartment fan 41 may operate at a higher speed to satisfy the required cooling power of the convertible compartment 11. Alternatively, the convertible compartment fan 41 and the refrigerator compartment fan 42 may be provided in different sizes so that more cold air is supplied into the convertible compartment 11.

Coupling hooks 98 may be provided at the edge of the shroud 90. The coupling hooks 98 may be coupled and fixed to the coupling portions 511 of the grill pan 50. The insulating sheet 60, the insulating member 70, and the insulating duct 80 in the grill pan assembly 40 may be coupled by securing the fasteners 56.

A vibration reduction member 43, such as Foam PU, may be attached to the edge of the grill pan assembly 40 that has been assembled. The gap between the edge of the grill pan assembly 40 and the inner side of the convertible compartment 11 can be sealed and vibration noise due to operation of the convertible compartment fan 41 or the refrigerator compartment fan 42 can be reduced by the vibration reduction member 43.

Figure 8:
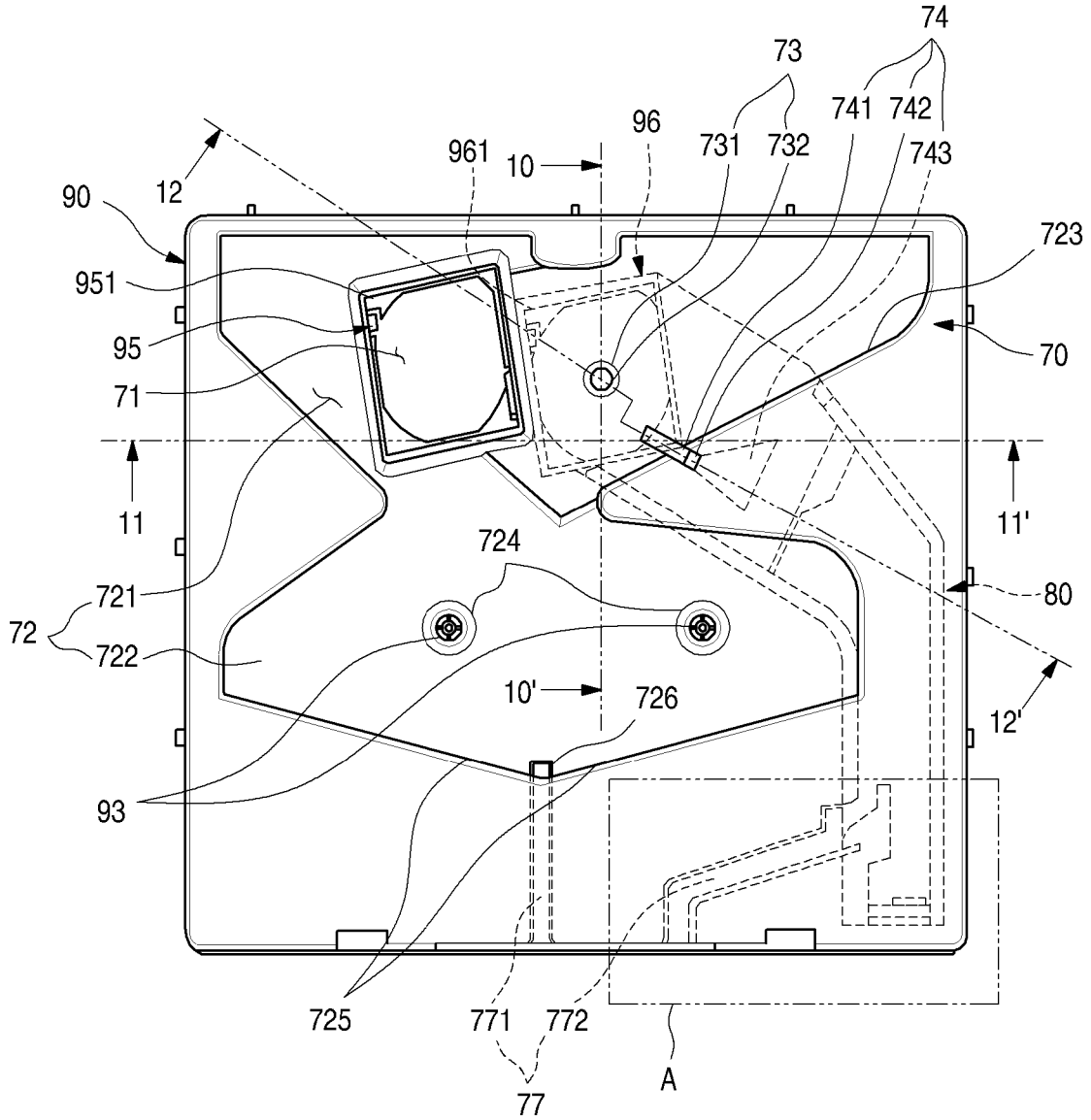
FIG. 8 is a front view of the grill pan assembly combined with a main heat insulator.
Figure 9:
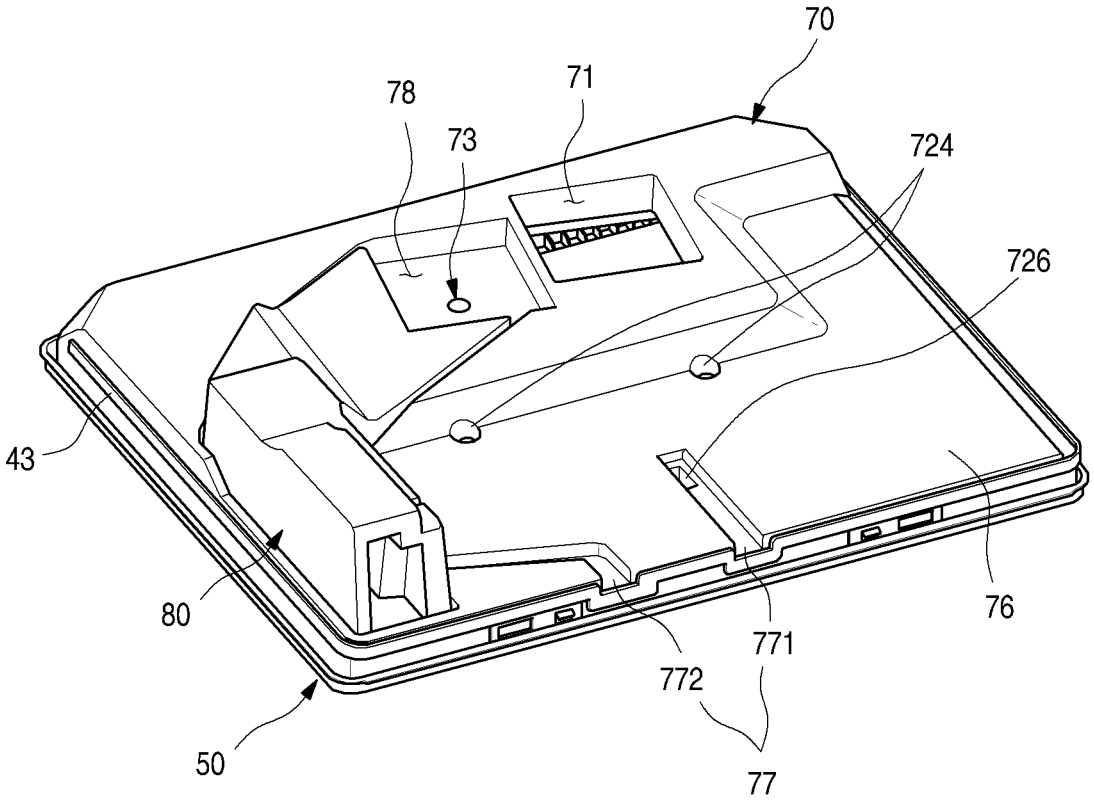
FIG. 9 is a rear view of the grill pan assembly combined with the main heat insulator.
Figure 10:
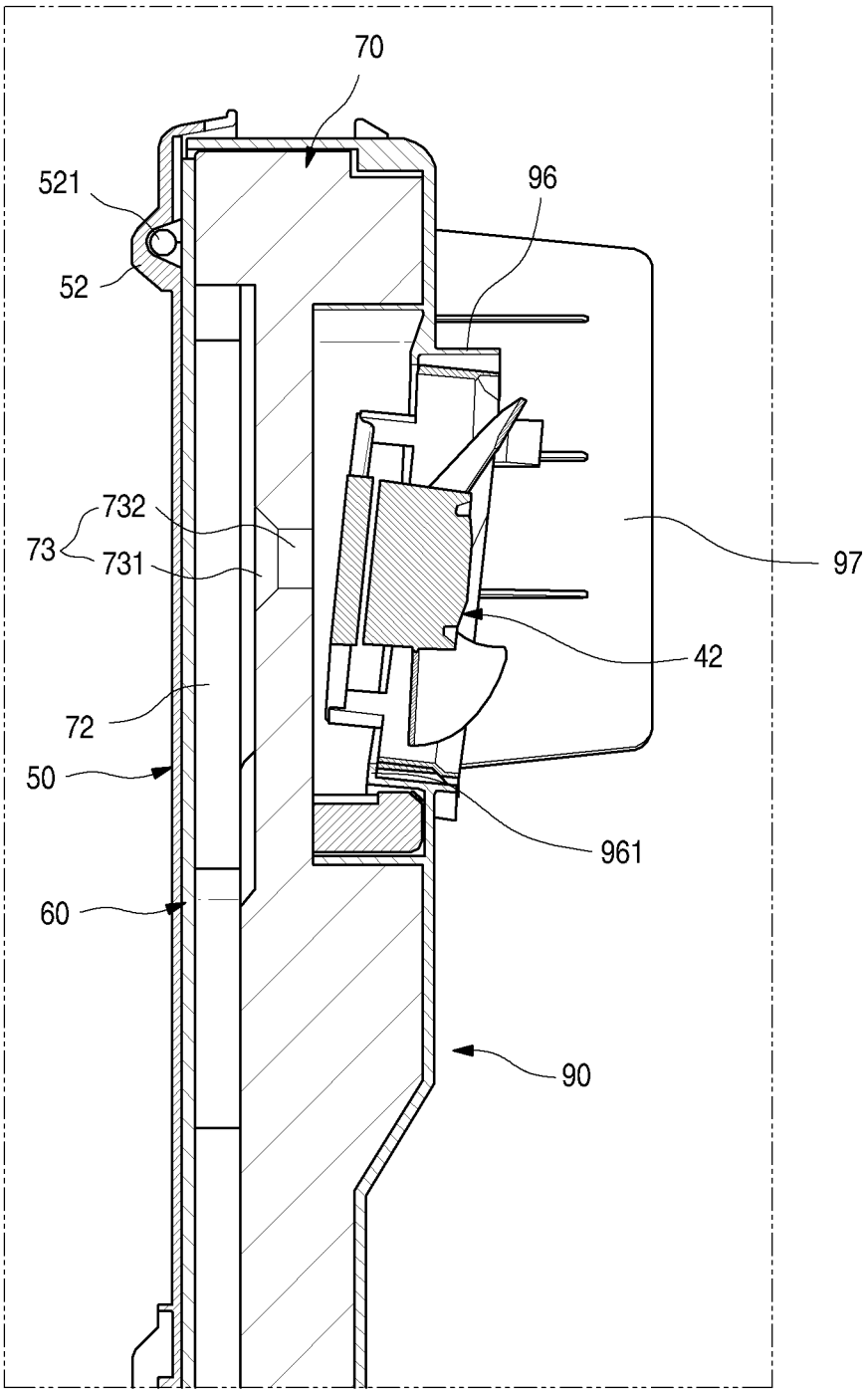
FIG. 10 is a cross-sectional view taken along line 10-10' of FIG. 8.
Figure 11:
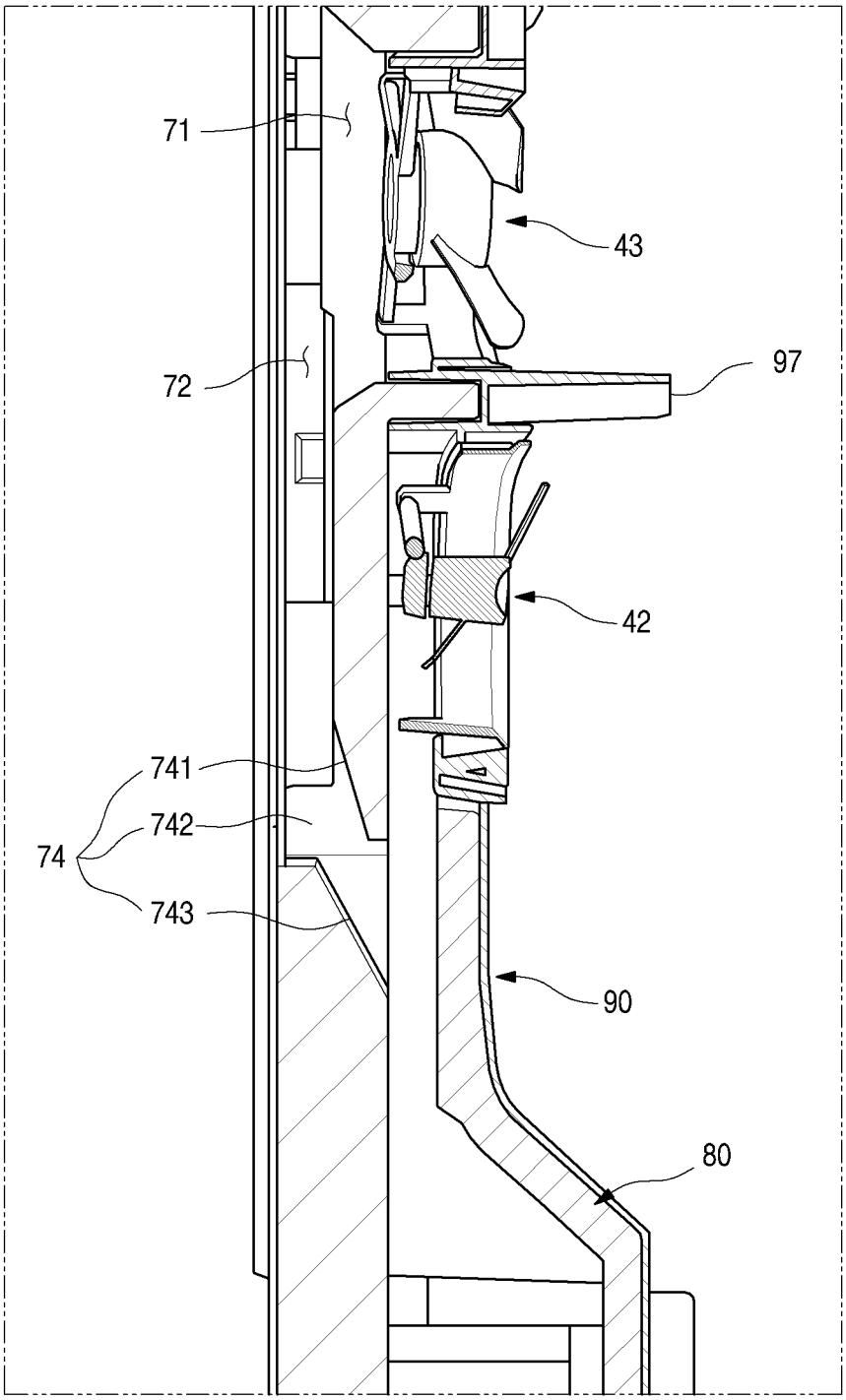
FIG. 11 is a cross-sectional view taken along line 11-11' of FIG. 8.

FIG. 8 is a front view of the grill pan assembly combined with a main heat insulator. FIG. 9 is a rear view of the grill pan assembly combined with the main heat insulator. FIG. 10 is a cross-sectional view taken along line 10-10' of FIG. 8. FIG. 11 is a cross-sectional view taken along line 11-11' of FIG. 8. Other embodiments and configurations may also be provided.

As shown, the negative pressure compensation hole 73 and the anti-backflow portion 74 may be provided at the refrigerator compartment channel 75 of the insulating member 70.

The negative pressure compensation hole 73 may be provide at a position corresponding to the position of the refrigerator compartment fan 42 in the refrigerator compartment channel 75. The negative pressure compensation hole 73 may be formed through a center portion of the refrigerator compartment inlet 78. That is, the negative pressure compensation hole 73, as shown in FIG. 10, may be positioned along an extension line from a rotational center of the refrigerator compartment fan 42. Accordingly, when the convertible compartment fan 41 and the refrigerator compartment fan 42 are both operated, an influence on flow by the negative pressure compensation hole 73 can be minimized.

The negative pressure compensation hole 73 may remove negative pressure that is generated at the refrigerator compartment inlet 78 and the refrigerator compartment fan mount 96 when the convertible compartment fan 41 is operated. The negative pressure compensation hole 73 may have an inlet 731 formed on the front side of the insulating member 70 and an extension 732 extending from the inlet 731 to the rear side of the insulating member 70.

The inlet 731 may get narrower as it goes inward, so as to guide the cold air that flows when the convertible compartment fan 41 is operated such that some of the cold air can easily flow into the negative pressure compensation hole 73. The extension 732 extends from the end of the inlet 731 to the refrigerator compartment inlet 78 so as to allow the air flowing in the negative pressure compensation hole 73 to be discharged to the refrigerator compartment inlet 78.

That is, when the refrigerator compartment fan 42 is stopped and only the convertible compartment fan 41 is operated, negative pressure may be generated at the refrigerator compartment fan 42 adjacent to the convertible compartment fan 41 by the convertible compartment fan 41. According to an example embodiment, there is no damper that switches channels for supplying cold air to the convertible compartment and the freezer, so when negative pressure is generated, air in the refrigerator compartment 12 may flow backward through the open insulating duct 80. When the air in the refrigerator compartment 12 flows back into the evaporator 15, temperature of the convertible compartment 11 increases, so the convertible compartment 11 may be overcooled when being cooled. Further, when high-humidity air in the refrigerator compartment 12 flows into the refrigerator compartment channel 75, the insulating duct 80 and the refrigerator compartment fan 42, frost may be produced and the channel may be clogged or frozen, so the refrigerator compartment fan 42 may not normally operate.

However, some of the air that flows when the convertible compartment fan 41 is operated can be discharged to the refrigerator compartment inlet 78 by the negative pressure compensation hole 73 such that negative pressure at the refrigerator compartment inlet 78 can be removed. Accordingly, air in the refrigerator compartment 12 may be prevented from flowing back to the evaporator 15 through the insulating duct 80.

The anti-backflow portion 74 may be formed outside the refrigerator compartment inlet 78, and inside the refrigerator compartment channel 75. The anti-backflow portion 74 may be open at the convertible compartment channel 72 and open to the inside of the refrigerator compartment channel 75 through the insulating member 70.

When frosting occurs in the evaporator 15, the space where the evaporator 15 is disposed is decreased and pressure is increased when air flows. Accordingly, when the convertible compartment fan 41 is operated, cold air in the refrigerator compartment 12 may flow backward through the insulating duct 80.

The anti-backflow portion 74 may prevent the backflow of the cold air in the refrigerator compartment 12, so as to block the air flowing backward from the refrigerator compartment 12 by supplying some of the air discharged to the convertible compartment channel 72 to the refrigerator compartment channel 75 when the convertible compartment fan 41 is operated.

The anti-backflow portion 74 may have an inlet guide 741 recessed at the convertible compartment channel 72, a through-portion 742 formed through the insulating member 70 from the end of the inlet guide 741, and an outlet guide 743 recessed at the refrigerator compartment channel 75.

The inlet guide 741 may extend from the convertible compartment channel 72 toward the first inclined portion 723. That is, the through-portion 742 at the end of the inlet guide 741 may be provided on the first inclined portion 723. The inlet guide 741 may be inclined inward as it goes to the through-portion 742 such that the air flowing through the convertible compartment channel 72 can smoothly flow toward the through-portion 742.

The inlet guide 741 may extend and incline in the rotational direction of the convertible compartment fan 41. That is, the position and direction of the inlet guide 741 may be determined such that the air discharged by the convertible compartment fan 41 may quickly flow inside.

The through-portion 742 may connect the inlet guide 741 and the outlet guide 743 and allow the air in the convertible compartment channel 72 to flow into the refrigerator compartment channel 75 through the insulating member 70. The through-portion 742 may be a portion of the inlet guide 741 and the outlet guide 743.

The outlet guide 743 may extend from the through-portion 742 toward the refrigerator compartment channel 75. The outlet guide 743 may increase in width as it goes away from the through-portion 742. The outlet guide 743 may increase in height as it goes away from the through-portion 742 to be close to the bottom of the refrigerator compartment channel 75.

That is, the air in convertible compartment channel 72 is guided through the through-portion 742 and flows into the refrigerator compartment channel 75 through the outlet guide 743, in which the air can uniformly spread to the refrigerator compartment channel 75 by the outlet guide 743 that becomes gradually wider. Accordingly, it is possible to effectively push and block the air flowing backward from the refrigerator compartment 12 through the insulating duct 78 in a large area.

Figure 12:
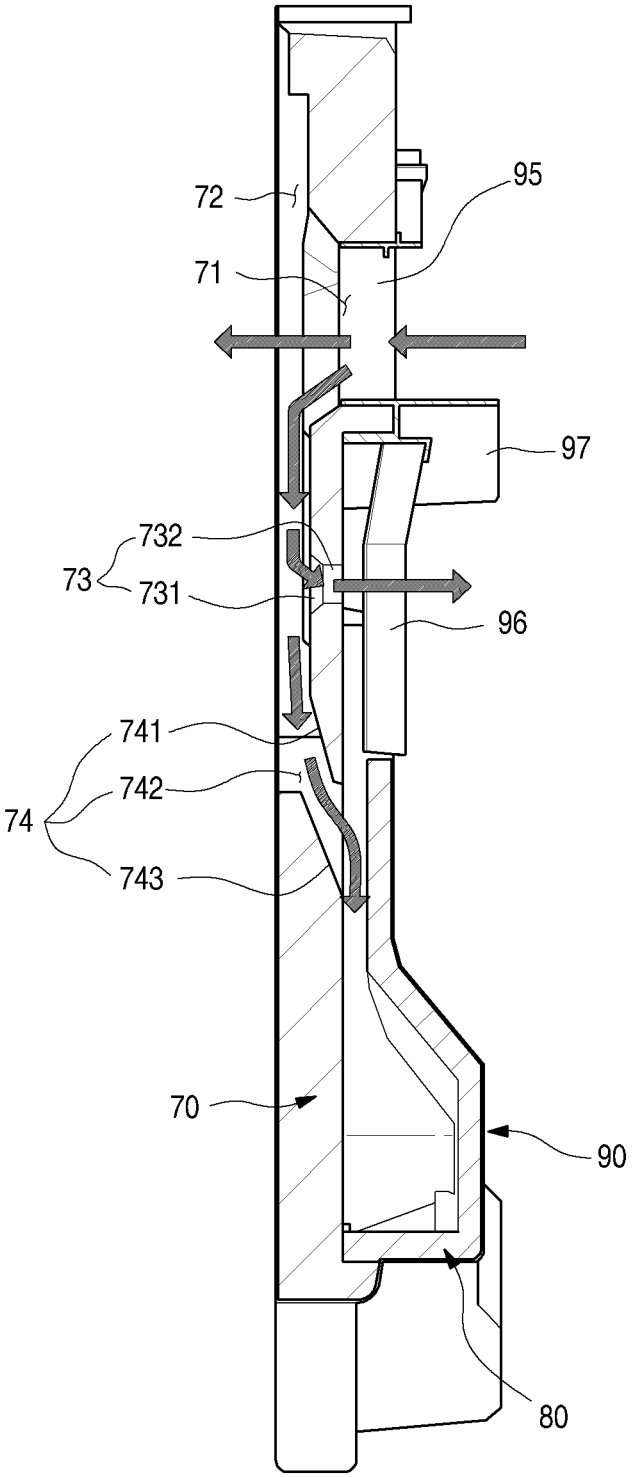
FIG. 12 is a cross-sectional view taken along line 12-12' of FIG. 8.
Figure 13:
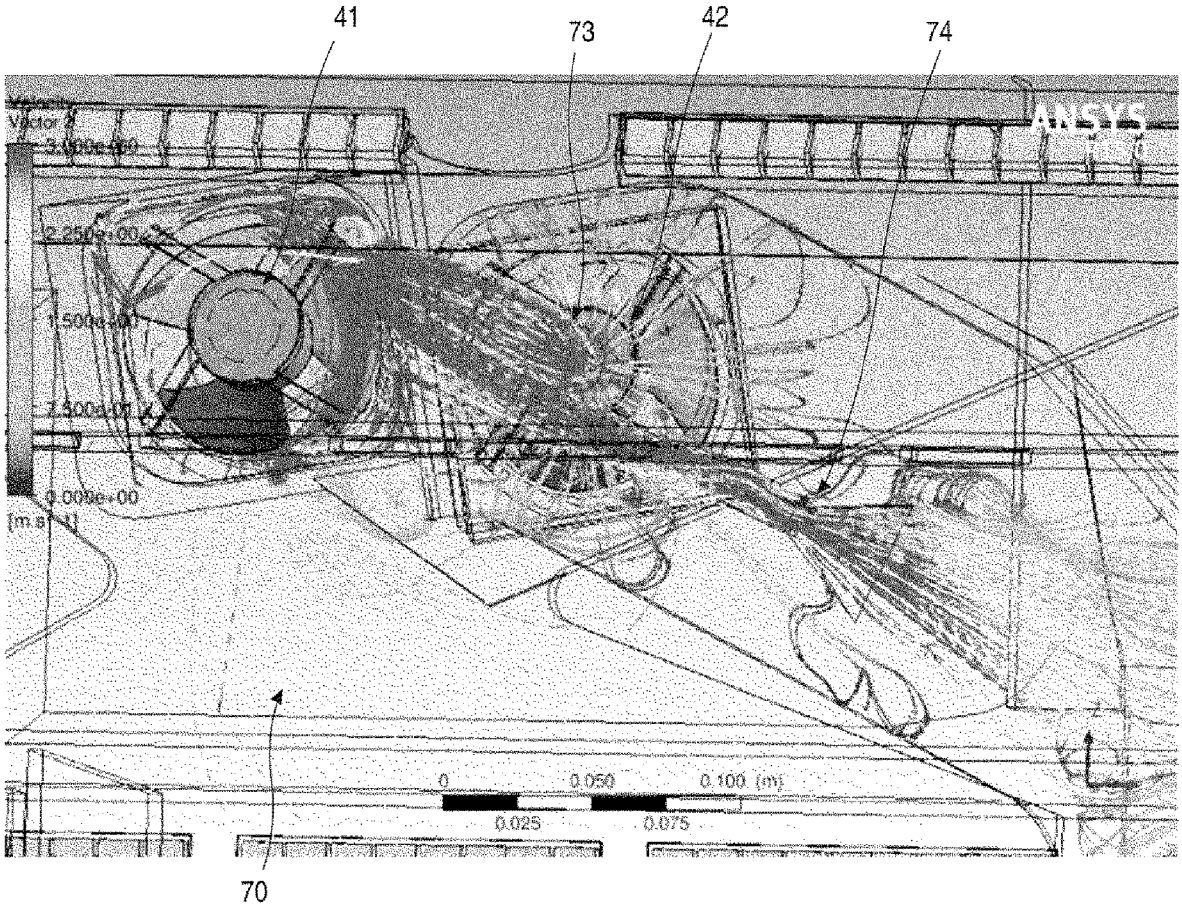
FIG. 13 is a view showing a simulation of airflow through the main heat insulator.

FIG. 12 is a cross-sectional view taken along line 12-12' of FIG. 8. FIG. 13 is a view showing a simulation of airflow through the main heat insulator. Other embodiments and configurations may also be provided.

As shown, when the convertible compartment fan 41 is operated to cool the convertible compartment 11 while the refrigerator compartment fan 42 is stopped, the cold air produced by the evaporator 15 may be supplied to the convertible compartment 11, thereby cooling the convertible compartment 11. In this example, when the relatively high-humidity air in the refrigerator compartment 12 flows back to the evaporator 15, the air freezes in the refrigerator compartment fan 42 and the insulating duct 80, in addition to the evaporator 15, so normal cooling may not be performed. Accordingly, the air in the refrigerator compartment 12 may be blocked not to flow backward in order to prevent this problem.

When only the convertible compartment fan 41 is operated with the refrigerator compartment fan 42 stopped, some of the air flowing into the convertible compartment channel 72 may be supplied to the refrigerator compartment inlet 78 through the negative pressure compensation hole 73 by operation of the convertible compartment fan 41. Accordingly, the negative pressure that is generated at the refrigerator compartment inlet 78 when the convertible compartment fan 41 is operated can be removed and the air in the refrigerator compartment 12 may be prevented from flowing into the space where the evaporator 15 is disposed through the insulating duct 80.

Some of the air discharged to the convertible compartment channel 72 by the convertible compartment fan 41 may pass through the anti-backflow portion 74. The negative pressure compensation hole 73 and the anti-backflow portion 74 may be positioned in the path through which air flows when the convertible compartment fan 41 is rotated clockwise (in FIG. 13) so that some of the discharged air can naturally flow into the negative pressure compensation portion 73 and the anti-backflow portion 74.

The air flowing into the inlet guide 741 of the anti-backflow portion 74 naturally flows along the slope of the inlet guide 741 and then flows into the refrigerator compartment channel 75 from the convertible compartment channel 72 through the through-portion 742. The air spreads through the outlet guide 743 in the refrigerator compartment channel 75 and is then discharged into the insulating duct 80. Accordingly, it is possible to push and block the air flowing backward from the refrigerator compartment 12. That is, the air supplied in the convertible compartment channel 72 by the anti-backflow portion 74 may be supplied in the opposite direction to the backflow direction of the air in the refrigerator 12, whereby it is possible to secondarily prevent the air in the refrigerator compartment 12 from flowing back into the space where the evaporator 15 is provided.

That is, it is possible to prevent, through two operations (or steps), the cold air in the refrigerator compartment 12 from flowing back into the space where the evaporator 15 is disposed when only the convertible compartment fan 41 is operated with the refrigerator compartment fan 42 stopped, using the negative pressure compensation hole 73 and the anti-backflow portion 74.

Figure 14:
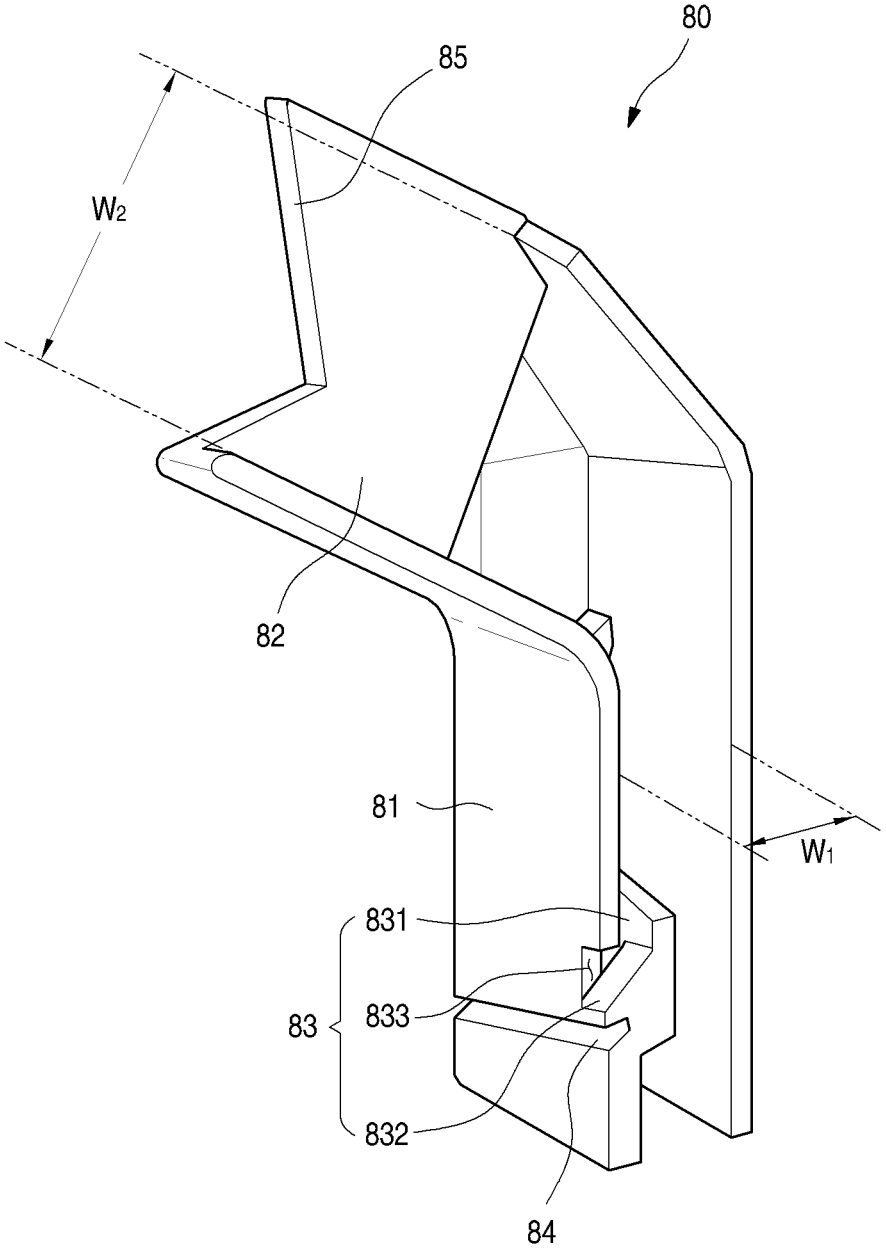
FIG. 14 is a front perspective view of an insulating duct according to an example embodiment.
Figure 15:
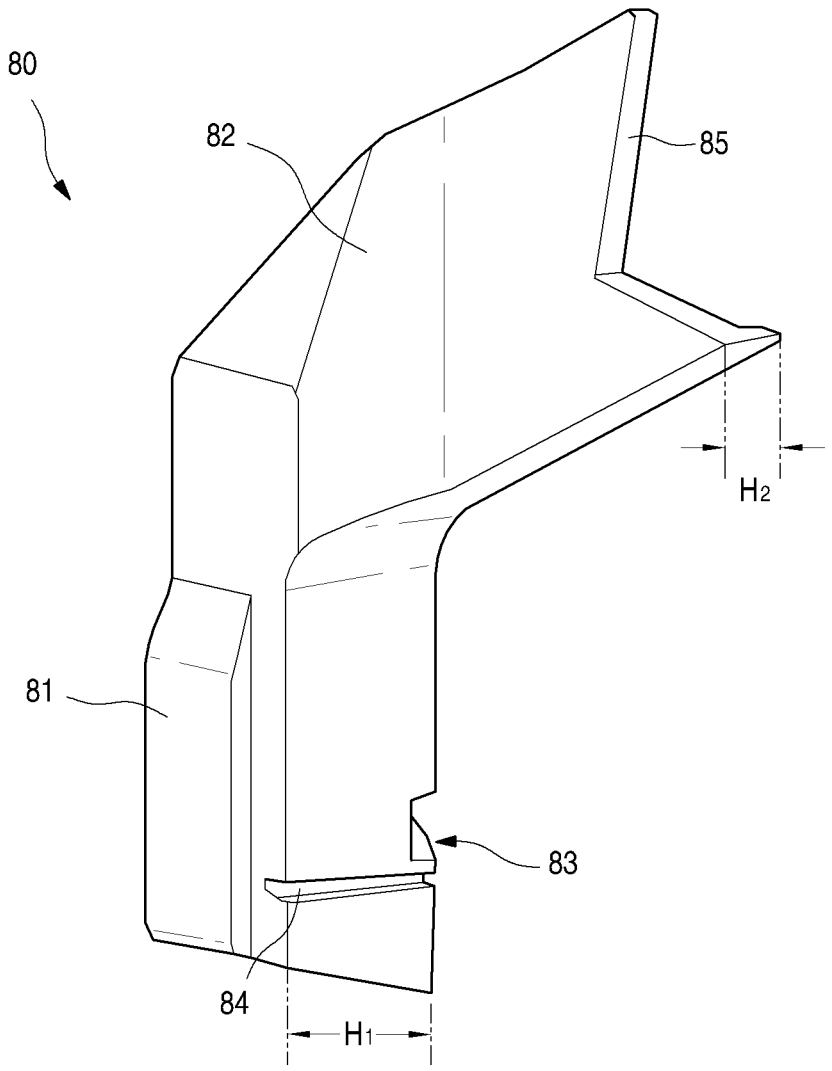
FIG. 15 is a rear perspective view of the insulating duct.
Figure 16:
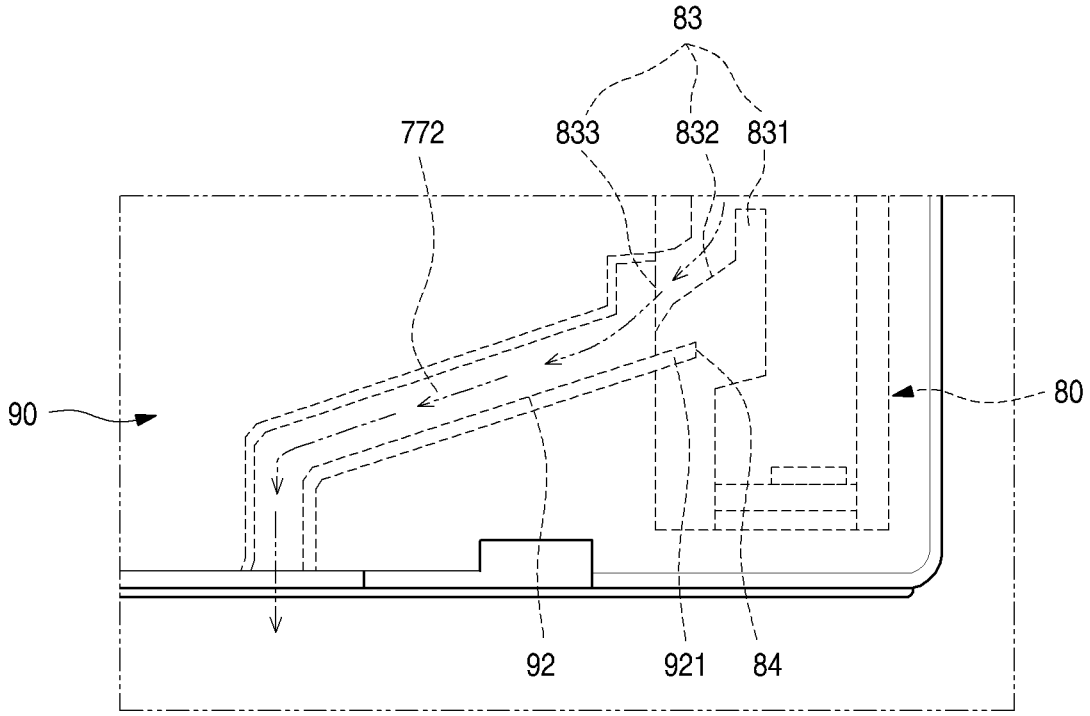
FIG. 16 is an enlarged view of the portion A of FIG. 8.

FIG. 14 is a front perspective view of the insulating duct according to an embodiment. FIG. 15 is a rear perspective view of the insulating duct. FIG. 16 is an enlarged view of the portion A of FIG. 8. Other embodiments and configurations may also be provided.

As shown, the insulating duct 80 extends from the refrigerator compartment fan mount 96 at the center portion of the grill pan assembly 40 to a side of the lower end of the grill pan assembly 40. The insulating duct 80 is formed in a shape corresponding to the recessed refrigerator compartment channel 75 of the insulating member 70 so the insulating duct 80 can be fitted in the refrigerator compartment channel 75.

The insulating duct 80 may have a lower part 81 disposed at a side of the evaporator seat 76 and an upper part 82 extending from the upper end of the lower part 81 to form the refrigerator compartment inlet 78 into which air is supplied by the refrigerator compartment fan 42.

A width W1 of the lower part 81 may be made smaller than a width W2 of the upper part 82 to maximize the space of the evaporator seat 76. On the other hand, the depth H1 of the lower part 81 is made larger than the depth H2 of the upper part 82, whereby it is possible to prevent the evaporator member 70 from being excessively thick at the upper portion protruding over the evaporator seat 76. That is, the width of the upper part 82 is larger than the width of the lower part 81, whereas the depth of the upper part 82 is smaller than the depth of the lower part 81.

According to this structure, the flow channel areas of the lower part 81 and the upper part 82 may be similar to each other. Accordingly, the amount of cold air supplied through the insulating duct 80 can be maintained at a predetermined level at the lower part 81 and the upper part 82, and the cold air can smoothly flow.

The lower part 81 may vertically extend from a side of the lower end of the insulating member 70 and protrude when being fitted in the refrigerator compartment channel 75. In this state, the lower part 81 may protrude at a height corresponding to the rear side of the evaporator 15 that has been mounted.

A duct water exit 83 that communicates with the second water discharge guide 772 may be formed at the lower part 81. The duct water exit 83 may be formed on the side, which is adjacent to the second water discharge guide 772, of both sides of the lower part 81. The duct water exit 83 may have a vertical guide 831, an inclined guide 832, and a connection hole 833.

The vertical guide 831 may be spaced inward from a side of the lower part 81 and may vertically extend. Accordingly, water dispersed by the air flowing through the insulating duct 80 can be guided to the inclined guide 832. The vertical guide 831 may be positioned above the connection hole 833.

The inclined guide 832 may be positioned at the lower end of the vertical guide 831 and may extend at an angle toward the lower end of the connection hole 833. Accordingly, the water guided by the vertical guide 831 can be guided to the connection hole 833. Further, the water flowing down along the slope of the upper part 82 can be guided to the connection hole 833.

The connection hole 833 may be at the same position as the open end of the second water discharge guide 772.

Accordingly, when the insulating duct 80 is mounted, the connection hole 833 can communicate with the second water discharge guide 772.

A rib projection 921 that protrudes toward the insulating duct seat 91 may be provided on the guide rib 92 of the shroud 90 that is inserted in the second water discharge guide 772. A slit 84, in which the rib projection 921 is inserted, may be provided on the outer side, which corresponds to the rib projection 921, of the lower part 81.

Accordingly, when the insulating duct 80 is mounted in the refrigerator compartment channel 75, the rib projection 921 may be inserted in the slit 84 so that the lower part 81 of the insulating duct 80 can be exactly positioned. Further, as the rib projection 921 and the slit 84 are fitted to each other, the connection hole 833 can communicate with the second water discharge guide 772 in close contact with the opening of the second water discharge outlet 772. According to this structure, the water flowing through the insulating duct 80 can flow to the second water discharge guide 772 through the duct water outlet 83 without flowing into the refrigerator compartment supply duct 114, and then it can be discharged to the machine room 14 through the defrost water tube 115.

The upper part 82 may extend from the upper end of the lower part 81 at an angle toward the refrigerator compartment pan mount 96. An upper end 85 that forms at least a portion of the edge of the refrigerator compartment inlet 78 may be formed at the upper end of the upper part 82. The upper end 85 forms the rectangular refrigerator compartment inlet 78 by being in contact with the upper end of the refrigerator compartment channel 75 when the insulating duct 80 is mounted.

Since the upper part 82 is inclined, water produced in the insulating duct 80 or at the refrigerator compartment fan can smoothly flow down, and can flow toward the second water discharge guide 772 by the duct water outlet 83.

Discharge of defrost water from the grill pan assembly may be described hereafter with reference to the drawings.

Figure 17:
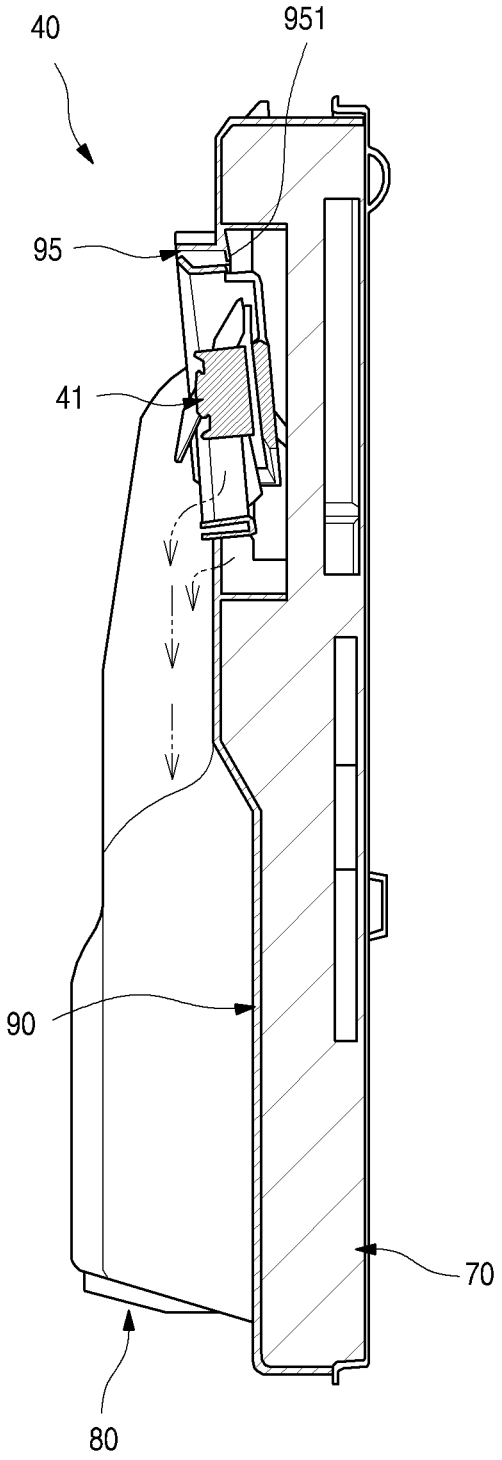
FIG. 17 is a vertical cross-sectional view showing discharge of defrost water from the grill pan assembly.
Figure 18:
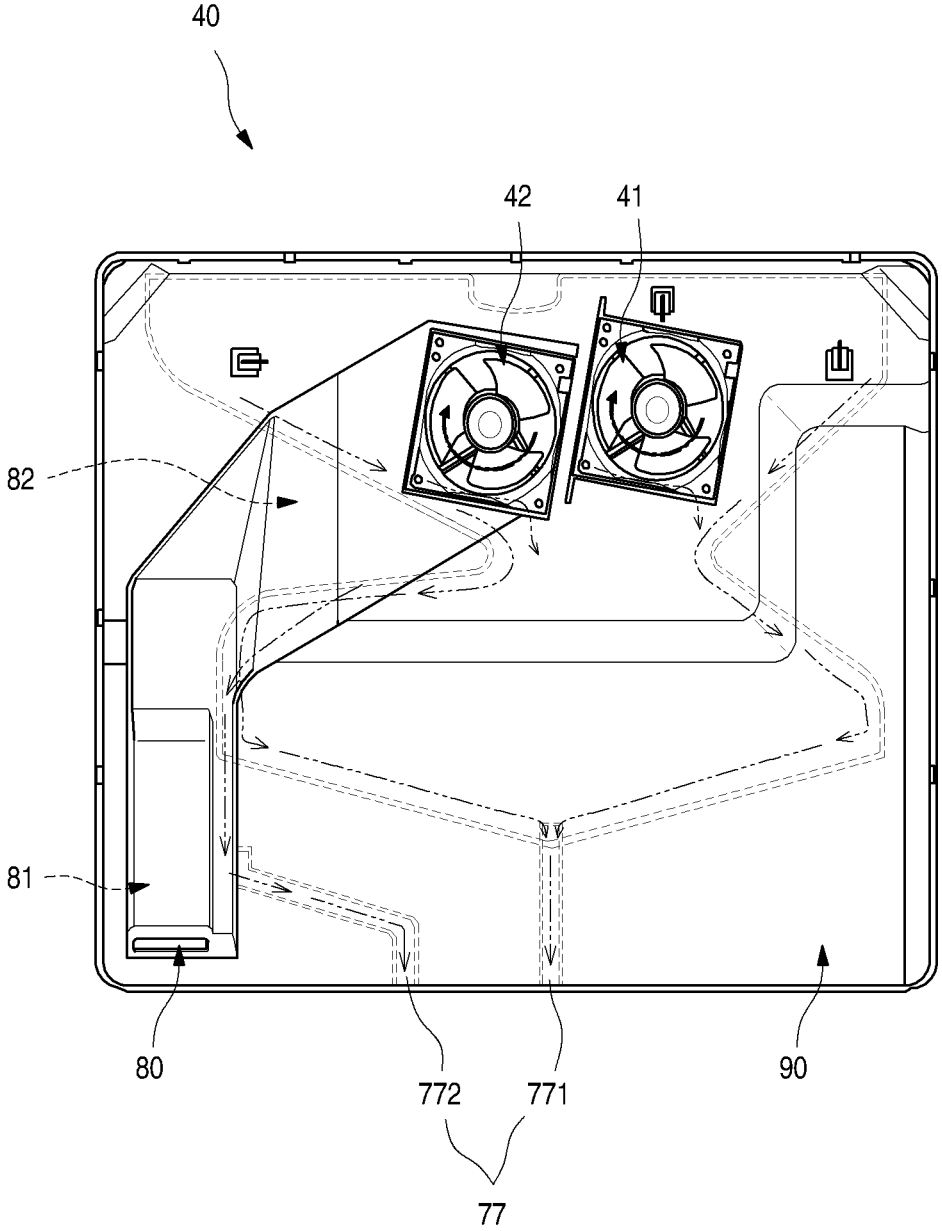
FIG. 18 is a rear view showing discharge of defrost water from the grill pan assembly.

FIG. 17 is a vertical cross-sectional view showing discharge of defrost water from the grill pan assembly. FIG. 18 is a rear view showing discharge of defrost water from the grill pan assembly. Other embodiments and configurations may also be provided.

Moisture or water produced in the refrigerator 1 while the refrigerator 1 is operated may stick to the evaporator 15 in the circulation process of air, whereby frost may be produced. Growth of the frost interferes with flow of air and causes unbalance of pressure, so a defrost operation may be performed by operating the defrost heater 16.

Frost at the convertible compartment fan 41 and the refrigerator compartment fan 42, and in the cold air channels, in addition to in the evaporator 15, can be removed by the defrost operation in which the defrost heater 16 generates heat, and defrost water produced in this process can be entirely discharged to the drain pan in the machine room 14.

The defrost operation may be necessary for the characteristic in which the convertible compartment 11 is used as the refrigerator compartment 12 and the freezer, and in this embodiment, a structure that can smoothly discharge defrost water that is produced in the defrost operation that is frequently performed can be provided.

That is, as shown in FIG. 17, defrost water produced on the convertible compartment fan 41 or the refrigerator compartment fan 42 after the defrost operation flows down along the convertible compartment fan 41 or the refrigerator compartment fan 42. The convertible compartment fan 41 or the refrigerator compartment fan 42 is inclined by the slopes of the seats 951 and 961 such that the upper portion further protrudes rearward. Accordingly, defrost water can flow down along the convertible compartment fan 41 or the refrigerator compartment fan 42.

The convertible compartment fan 41 or the refrigerator compartment fan 42 may be mounted at an angle in the rotational direction with the lower end at the lowest position, so defrost water can effectively flow down to the lower end of the convertible compartment fan 41 or the refrigerator compartment fan 42.

Since the lower end of the convertible compartment fan 41 or the refrigerator compartment fan 42 protrudes further than the rear side of the grill pan assembly 40, the defrost water flowing down can move down along the rear side of the grill pan assembly 40 and can be discharged to the drain pan in the machine room 14 through the drain member 116 and the defrost water tube 115 formed in the bottom of the convertible compartment 11.

Defrost water that is produced in the grill pan assembly 40 can be discharged down out of the grill pan assembly 40 by the first water discharge guide 771 and the second water discharge guide 772.

Defrost water that is produced from frost in the convertible compartment channel 72 may flow to the lower end of the convertible compartment channel 72, pass through the insulating member 70 through the water discharge hole 726, and may then be discharged along the first water discharge guide 771. The first water discharge guide 771 may be open through the lower end of the grill pan assembly 40 and defrost water may be discharged to the machine room 14 through the drain member 116 and the defrost tube 115 in the bottom of the convertible compartment 11.

Defrost water made from the frost in the insulating duct 80 and the refrigerator compartment channel 75 flows down sequentially along the inclined upper part 82 and the lower part 81 of the insulating duct 80. The defrost water flowing down along the sides of the lower part 81 flows into the second water discharge guide 772 through the duct water exit 83. The second water discharge guide 772 is also open through the lower end of the grill pan assembly 40 and defrost water can be discharged to the machine room 14 through the drain member 116 and the defrost tube 115 in the bottom of the convertible compartment 11.

Accordingly, defrost water produced inside and outside the grill pan assembly 40 can be completely smoothly discharged to the machine room 14.

Flow of cold air in the refrigerator according to an embodiment is described hereafter in detail with reference to the drawings.

Figure 19:
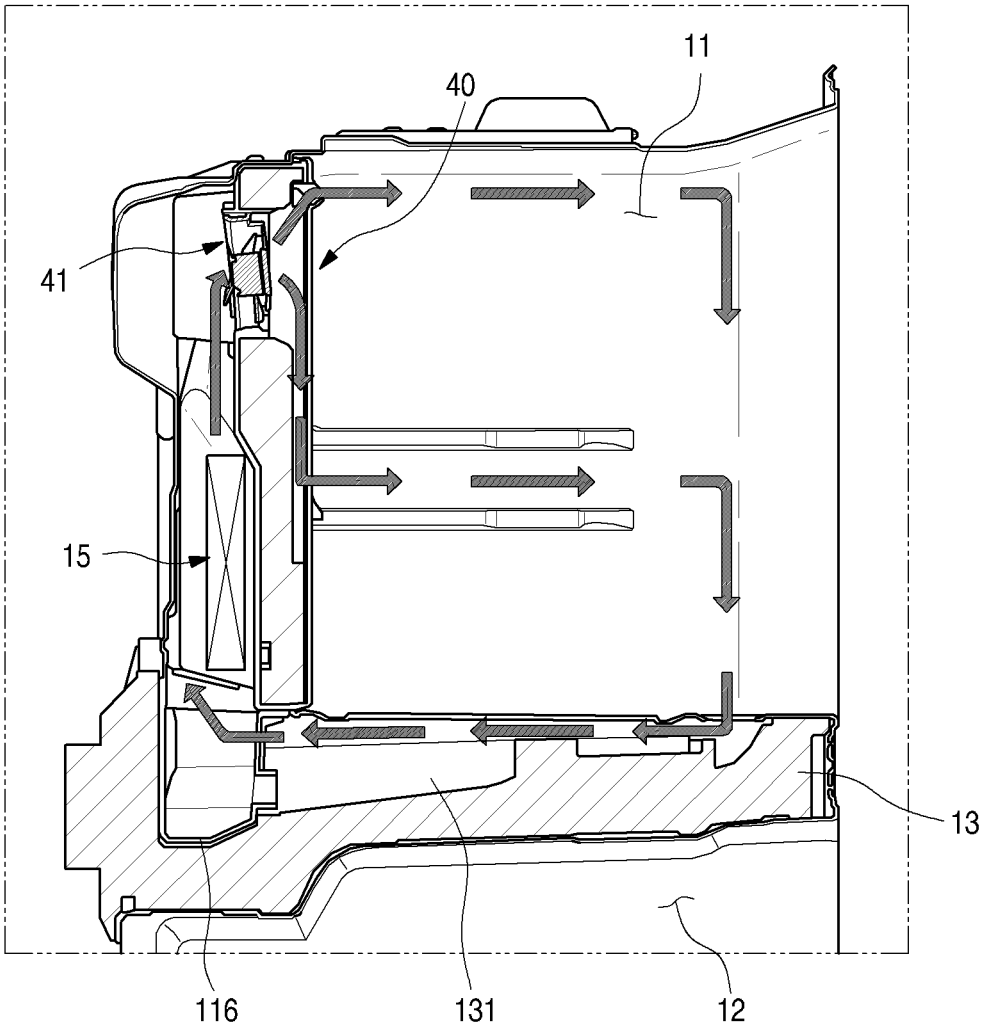
FIG. 19 is a vertical cross-sectional view showing flow of cold air to the convertible compartment of the refrigerator.
Figure 20:
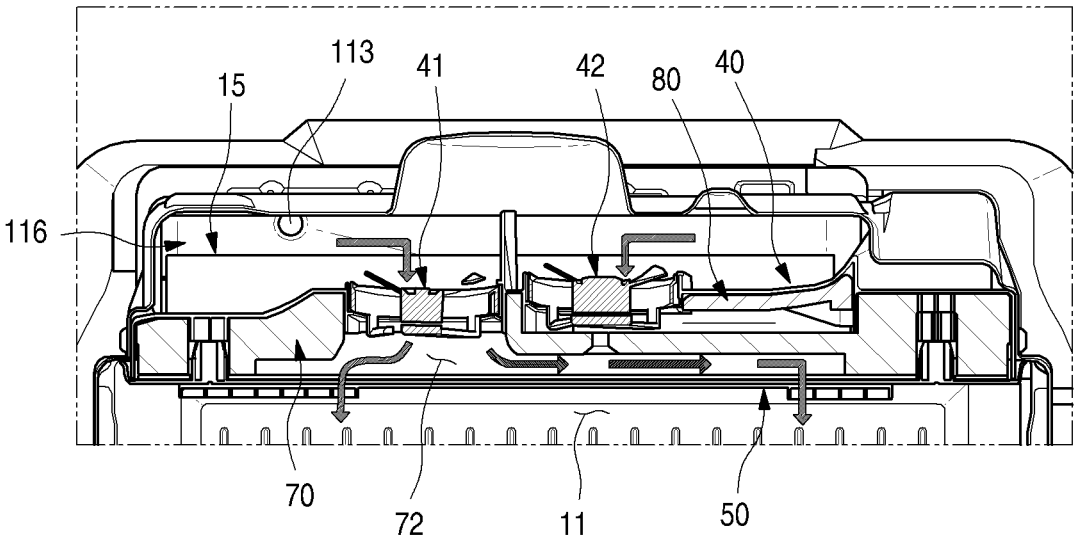
FIG. 20 is a horizontal cross-sectional view showing flow of cold air to the convertible compartment and the refrigerator compartment.
Figure 21:
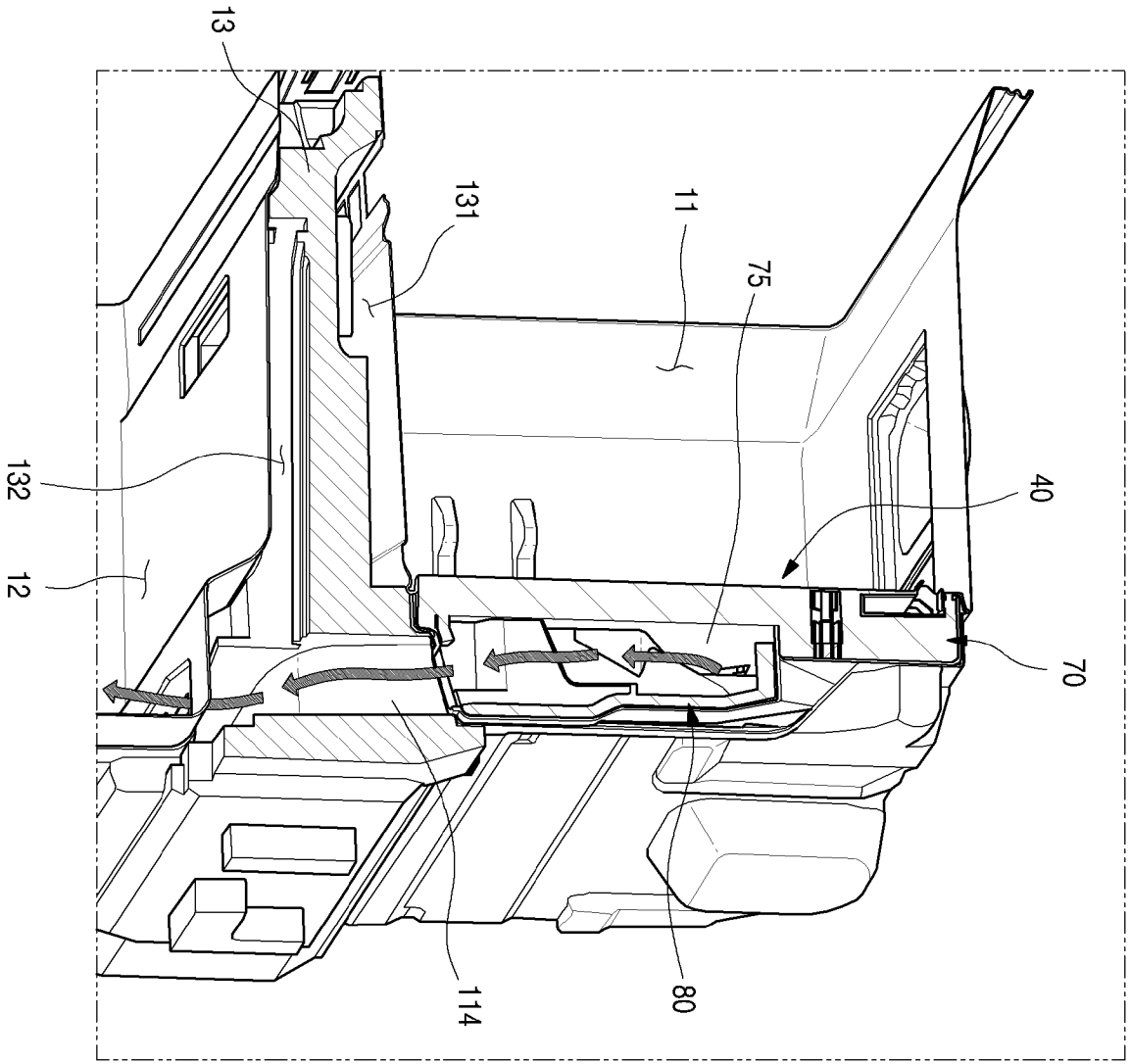
FIG. 21 is a vertical cross-sectional view showing flow of cold air to the refrigerator compartment.

FIG. 19 is a vertical cross-sectional view showing flow of cold air to the convertible compartment of the refrigerator. FIG. 20 is a horizontal cross-sectional view showing flow of cold air to the convertible compartment and the refrigerator compartment. FIG. 21 is a vertical cross-sectional view showing flow of cold air to the refrigerator compartment. Other embodiments and configurations may also be provided.

As shown, when the convertible compartment fan 41 is turned on, cold air produced by the evaporator 15 flows into the convertible compartment channel 72 through the convertible compartment fan 41 from the rear of the grill pan assembly 40. The cold air flowing in the convertible compartment channel 72 can be supplied into the convertible compartment 11 through the upper pan exits 53 and the lower pan exits 55 of the grill pan 50. A larger amount of cold air may be supplied through the upper pan exits 53 and concentration of cold air in the convertible compartment 11 can be minimized.

The cold air flowing in the convertible compartment 11 may cool the inside of the convertible compartment 11 and then can be returned to the space where the evaporator 15 is disposed through the convertible compartment return duct 131. The cold air returned to the space where the evaporator 15 is disposed can be cooled again by the evaporator 15. The convertible compartment 11 can be cooled to a setting temperature by this circulation process and operation of the convertible compartment fan 41 can be controlled by the convertible compartment temperature sensor 521.

The convertible compartment 11 may be used as a freezer compartment at a freezer temperature, and may be used as a refrigerator compartment at a refrigerator temperature, depending on selection of a user.

On the other hand, when the refrigerator compartment fan 42 is turned on, the air cooled by the evaporator 15 flows into the insulating duct 80 through the refrigerator compartment fan 42 and the refrigerator compartment inlet 78. The cold air flowing through the insulating duct 80 can be supplied into the multi-duct 121 in the refrigerator compartment 12 through the refrigerator compartment supply duct 114, and the cold air is discharged into the refrigerator compartment 12 from the multi-duct 121.

The cold air supplied into the refrigerator compartment 12 may cool the refrigerator compartment 12 by exchanging heat in the refrigerator compartment. The air that has exchanged heat in the refrigerator compartment 12 can be returned to the space where the evaporator 15 is disposed, through the refrigerator compartment return duct 132 in the top of the refrigerator compartment 12 (i.e., in the bottom of the barrier). The cold air returned to the space where the evaporator 15 is disposed can be cooled again by the evaporator 15. The refrigerator compartment 12 can be cooled to a set temperature by this circulation process and operation of the convertible compartment fan 41 can be controlled by the refrigerator compartment temperature sensor 122.

Operation of the refrigerator according to an embodiment is described hereafter with reference to the drawings.

Figure 22:
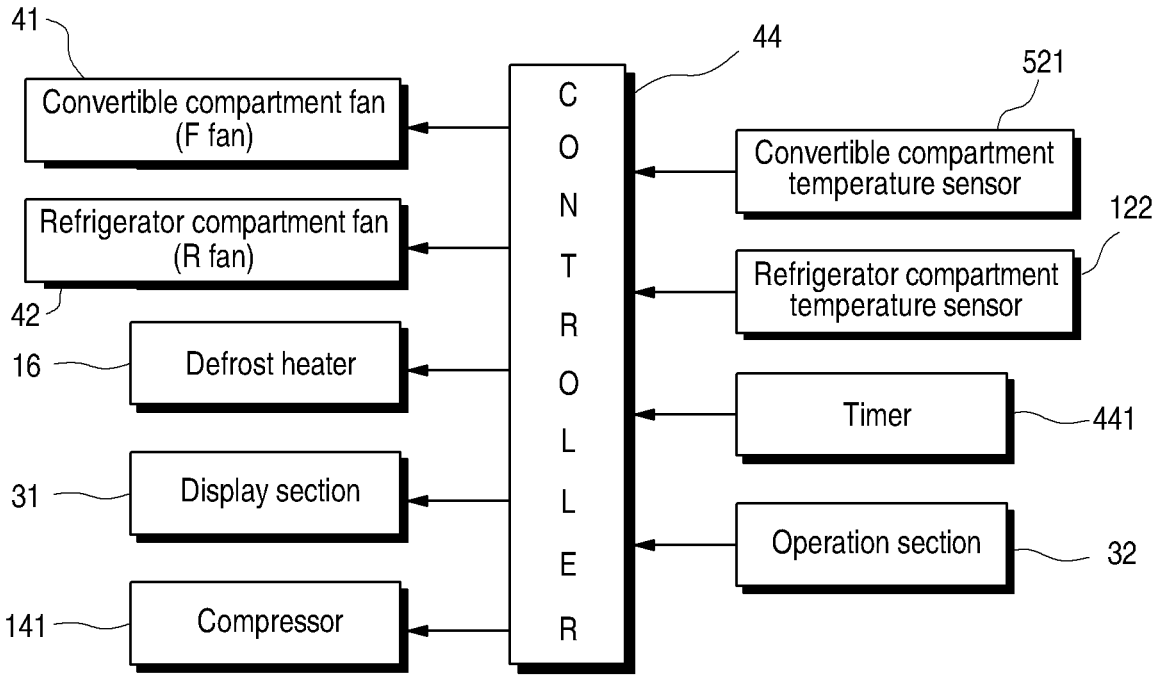
FIG. 22 is a block diagram showing components connected to a controller of the refrigerator.
Figure 23:
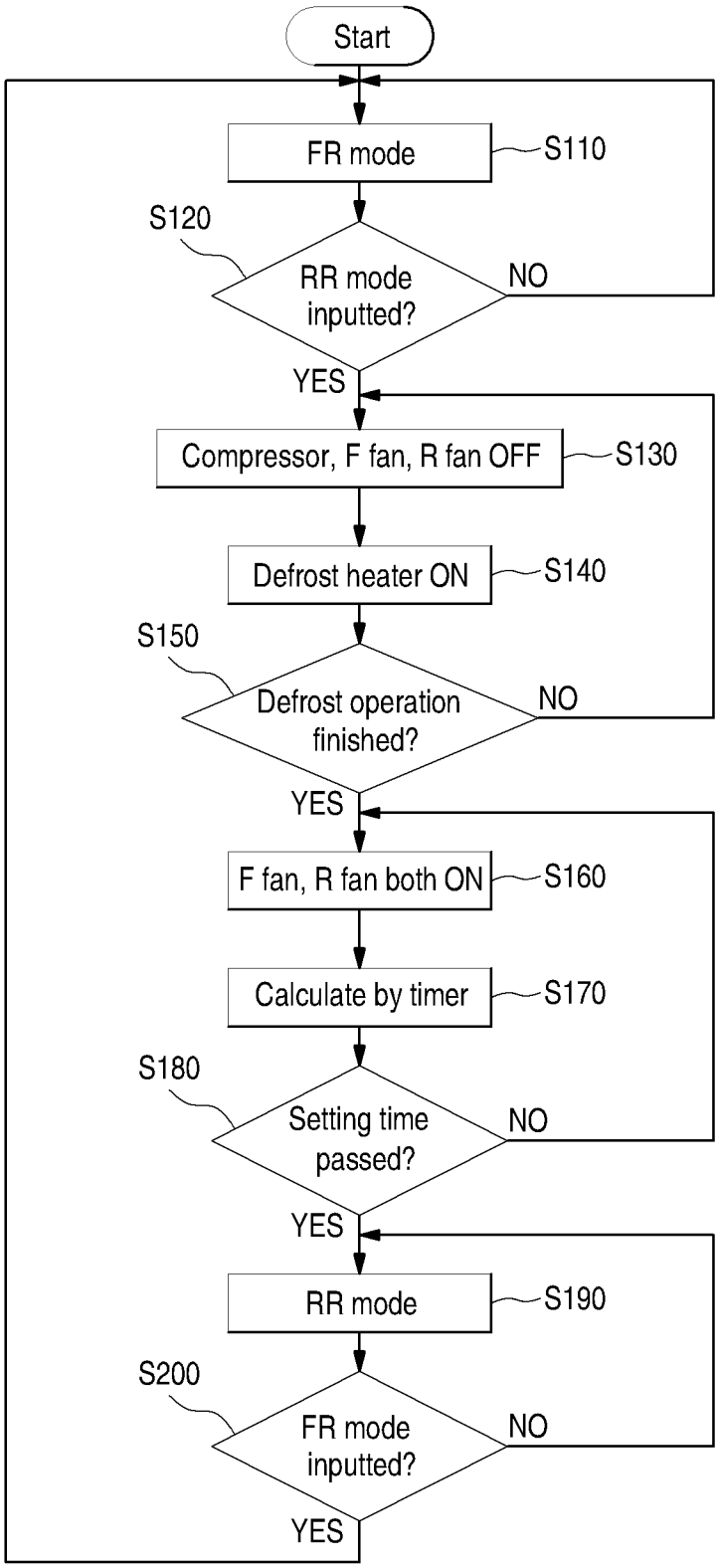
FIG. 23 is a flowchart sequentially illustrating an operation switch process of the refrigerator.
Figure 24:
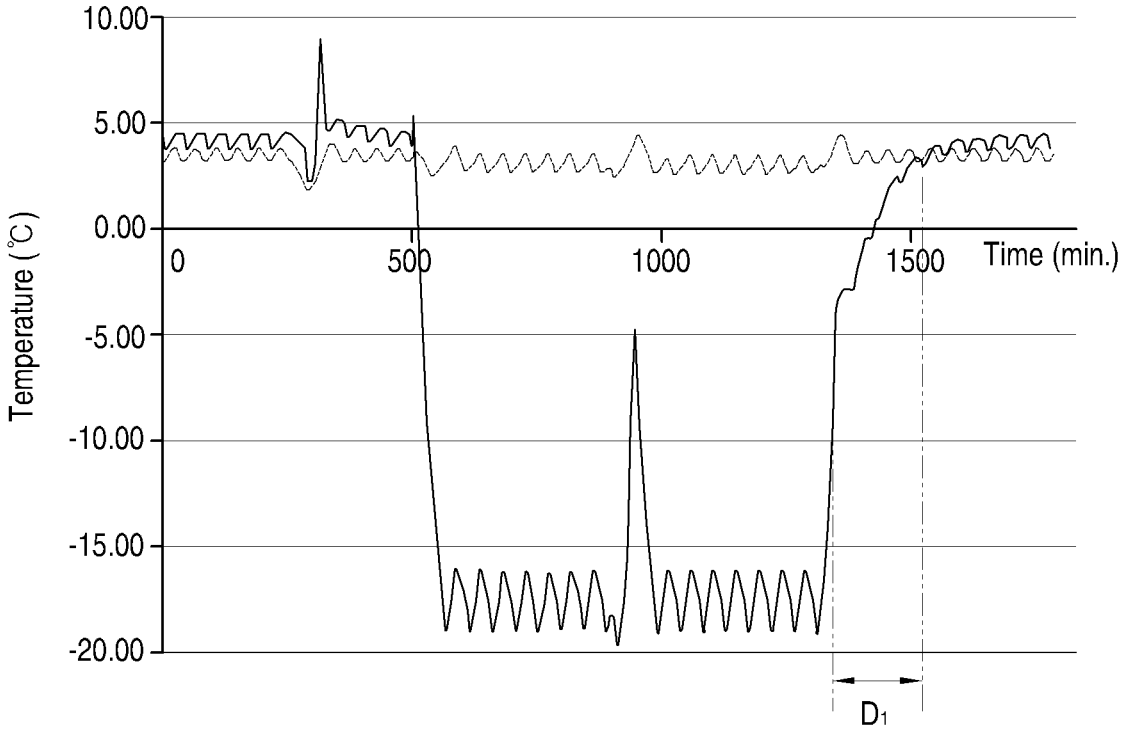
FIG. 24 is a graph showing a temperature change depending on an operation switch of the refrigerator.

FIG. 22 is a block diagram illustrating components connected to a controller of the refrigerator. FIG. 23 is a flowchart sequentially illustrating an operation switch process of the refrigerator. FIG. 24 is a graph showing a temperature change depending on operation switch of the refrigerator. Other embodiments and configurations may also be provided.

As shown, the refrigerator 1 can be operated in an FR mode in which the convertible compartment 11 is set at a freezer temperature by a controller 44 in a normal operation state. While the refrigerator 1 is operated in the FR mode, the refrigerator 1 may maintain a freezer temperature and a refrigerator temperature through the convertible compartment 11 and the refrigerator compartment 12.

That is, the convertible compartment 11 can be set at a temperature lower than the temperature of the refrigerator compartment 12, and operation of the compressor 141 and the convertible compartment fan 41 can be controlled by the convertible compartment sensor 521, whereby temperature of −15 to −20° C. can be maintained. The operation in the FR mode (S110) may be described below in more detail.

Meanwhile, the refrigerator 1 that is in operation in the FR mode may be switched into an RR mode by a user operating the operation section 32 (S120).

When it is determined that a user has input an RR mode, the compressor 141, the convertible compartment fan 41, and the refrigerator compartment fan 42 can be turned off (S130). Further, the defrost heater 16 is also turned on and quickly increases the temperature of the evaporator 15 and the space where the evaporator 15 is disposed. That is, when the RR mode is input, the defrost operation can be performed and the temperature of the evaporator 15 is increased (for example, −5~−7° C.) by the defrost operation. The defrost operation can be performed even in the normal FR mode, and it may be continued when an RR mode is entered. The defrost heater 16 may keep the defrost operation by keeping turned on for a predetermined time or until the temperature around the evaporator 15 reaches a setting temperature (S140).

When the defrost operation is finished (8150), the defrost heater 16 is turned off, and the convertible compartment fan 41 and the refrigerator compartment fan 42 are also turned off. Accordingly, the air in the refrigerator compartment 12 and the air in the convertible compartment 11 are forcibly circulated and consequently can be mixed in the space where the evaporator 15 is disposed. Therefore, the convertible compartment 11 and the refrigerator compartment 12 can be adjusted at the same temperature by mixture of the air. The temperature of the convertible compartment 11 can be quickly increased, as in the period D1 in FIG. 12, by the defrost operation and mixture of the air in the convertible compartment 11 and the refrigerator compartment 12 (S160).

As the convertible compartment fan 41 and the refrigerator compartment fan 42 are simultaneously turned on, a timer 441 may calculate the operation time of the convertible compartment fan 41 and the refrigerator compartment fan 42. Further, the convertible compartment fan 41 and the refrigerator compartment fan 42 may keep operating for a set time (for example, 5 minutes) so that the air in the convertible compartment 11 and the refrigerator compartment 12 is completely mixed at the same temperature (S170).

When the set time has passed in this state (S180), the refrigerator 1 is operated in the RR mode. In the RR mode, the convertible compartment 11 is set at the refrigerator temperature and both of the convertible compartment 11 and the refrigerator compartment 12 can be operated at the refrigerator temperature. That is, the operation of the compressor 141 and the refrigerator compartment fan 42 are controlled by the refrigerator compartment temperature sensor 122 and operation of the convertible compartment fan 41 is controlled by the convertible compartment temperature sensor 521, so the refrigerator compartment 12 and the convertible compartment 11 are maintained temperature of 3° C.~6° C. The operation in the RR mode (S190) will be described below in more detail.

When a user inputs the FR mode by operating the operation section 32 with the refrigerator 1 operating in the RR mode, the RR mode is stopped and the FR mode is started (S200).

Figure 25:
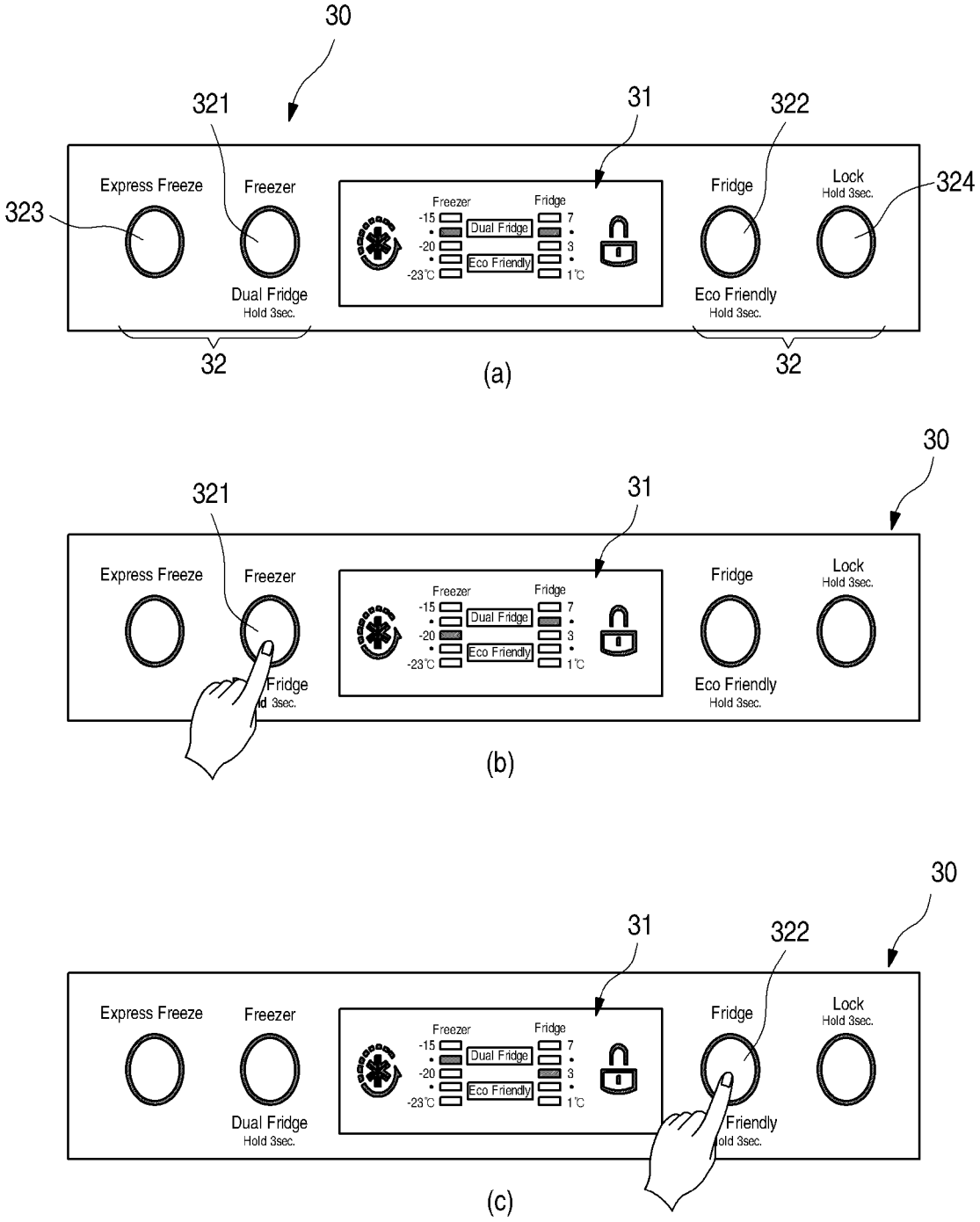
FIG. 25 shows views of an operation state of a display in an FR mode of the refrigerator.

FIGS. 25(*a*)-25(*c*) are views showing an operation state of the display in the FR mode of the refrigerator. Other configurations may also be provided.

As shown in FIG. 25(*c*), when the refrigerator 1 is operated in the FR mode, a set temperature can be displayed through the display section 31. A user can independently set the temperatures of the convertible compartment 11 and the refrigerator compartment 12 by operating the operation section 32.

As shown in FIG. 25(*b*), the user presses the convertible compartment button 321 to adjust the temperature of the convertible compartment 11. When the convertible compartment button 321 is pressed, the temperature of the convertible compartment 11 can be set step by step, and every time the convertible compartment button 321 is pressed, the changed set temperatures can be displayed by turning on/off on the display section 31.

As shown in FIG. 25(*c*), the user presses the refrigerator compartment button 322 to adjust the temperature of the refrigerator compartment 12. When the refrigerator compartment button 322 is pressed, the temperature of the refrigerator compartment 12 can be set step by step, and every time the refrigerator compartment button 322 is pressed, the changed setting temperatures can be displayed by turning on/off on the display section 31.

Figure 26:
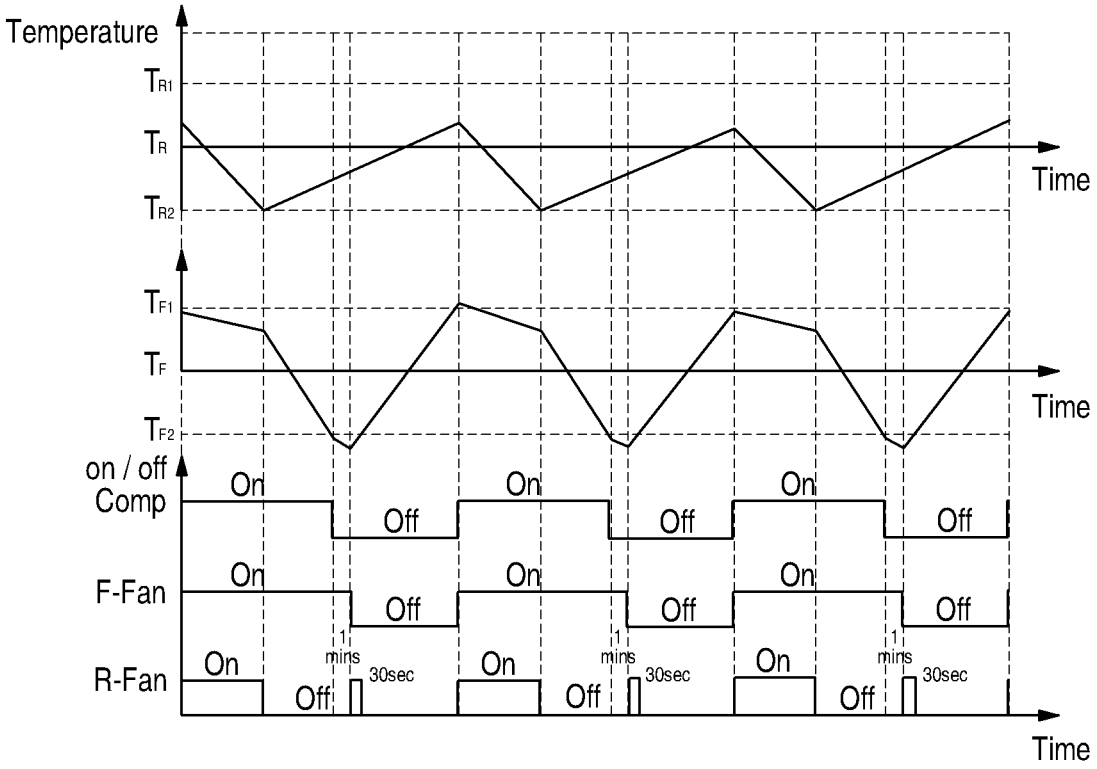
FIG. 26 is a graph showing an operation state of the refrigerator in the FR mode.

FIG. 26 is a graph showing an operation state of the refrigerator in the FR mode.

As shown, when the refrigerator 1 is operated in the FR mode, the compressor 141 can be turned on/off, depending on the temperature of the convertible compartment 11 detected by the convertible compartment temperature sensor 521. That is, when the temperature of the convertible compartment 11 reaches an upper limit temperature Tf1, the compressor 141 is turned on, and when the temperature of the convertible compartment 11 reaches a lower limit temperature Tf2, the compressor 141 is turned off.

The refrigerator compartment fan 42 can be turned on together with the compressor 141 when the compressor 141 is turned on. In this state, the temperature of the refrigerator compartment 12 detected by the refrigerator compartment temperature sensor 122 would be the lower limit temperature Tr2 or more, and if the temperature of the refrigerator compartment 12 is the lower limit temperature Tr2 or less, the compressor 141 keeps turned off even if it is supposed to be turned on. The refrigerator compartment fan 42 is turned off when the temperature of the refrigerator compartment 12 reaches the lower limit temperature Tr2. Accordingly, the refrigerator compartment fan 42 can maintain the temperature of the refrigerator compartment 12 between the upper limit temperature Tr1 and the lower limit temperature Tr2 by keeping supplying the cold air from the evaporator 15 to the refrigerator compartment 12 until the temperature of the refrigerator compartment 12 reaches the lower limit temperature Tr2.

The convertible compartment fan 41 is turned on together with the compressor 141 when the compressor 141 is turned on, and cools the convertible compartment 11 by supplying the cold air from the evaporator 15 into the convertible compartment 11. That is, when the temperature of the convertible compartment 11 reaches the upper limit temperature Tf1, the convertible compartment fan 41 is turned on together with the compressor 141. Further, when the temperature of the convertible compartment 11 reaches the lower limit temperature Tf2, the convertible compartment fan 41 provides additional cooling power by further operating for a set time (for example, 1 minute) after the compressor 141 is stopped, and is then turned off.

When the convertible compartment fan 41 is stopped after the compressor 141 is stopped, the refrigerator compartment fan 42 may be temporarily turned on for a set time (for example, 30 seconds) and then turned off. As the refrigerator compartment fan 42 is further operated, as described above, concentration of cold air in the refrigerator compartment 12 can be prevented.

The convertible compartment 11 may operate as a freezer compartment in the FR mode, so the convertible compartment 11 can be further cooled. Accordingly, the input voltage for the convertible compartment fan 41 may be higher than the input voltage for the refrigerator compartment fan 42 in the FR mode. That is, it is possible to supply a larger amount of cold air into the convertible compartment 11 by making the number of revolutions of the convertible compartment fan 41 larger than that of the refrigerator compartment fan 42.

Figure 27:
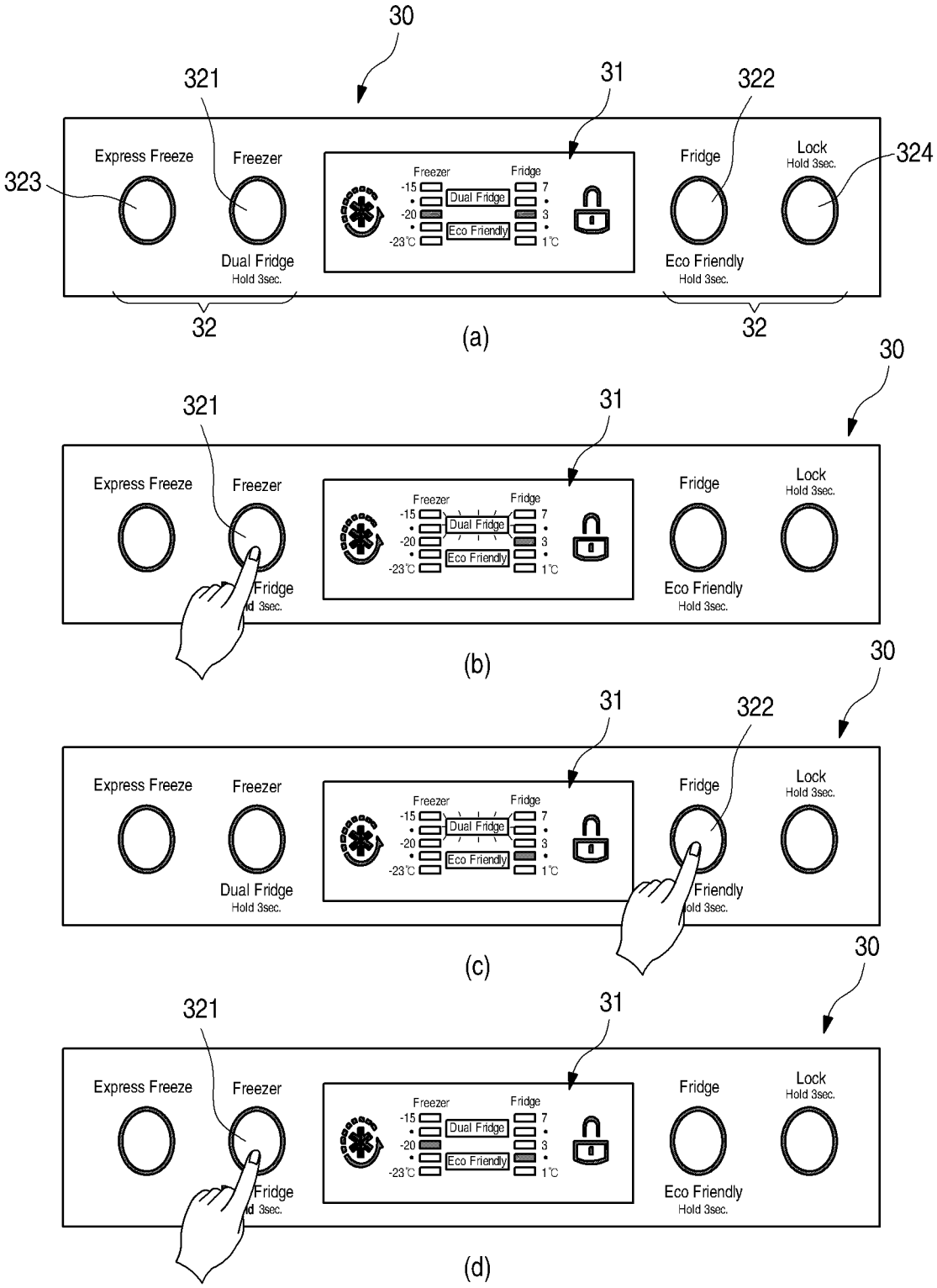
FIG. 27 shows views of an operation state of a display in an RR mode of the refrigerator.

FIGS. 27(*a*) to 27(*d*) are views showing the operation state of the display in an RR mode of the refrigerator.

As shown in FIG. 27(*a*), when the refrigerator 1 is operated in the FR mode, a set temperature can be displayed through the display section 31. A user can independently adjust the temperatures of the convertible compartment 11 and the refrigerator compartment 12 by operating the operation section 32.

As shown in FIG. 27(*b*), the user presses the convertible compartment button 321 for a set time (for example, 3 seconds) to switch into the RR mode. When the convertible compartment button 321 is pressed for the setting time, the controller 344 recognizes the switch into the RR mode and makes the refrigerator 1 operate in the RR mode. Further, the portion for showing the temperature of the convertible compartment 11 may be turned off and the portion showing selection of the RR mode may be turned on in the display section 31. The portion showing the temperature of the refrigerator compartment 12 may keep showing the set temperature of the refrigerator 1.

When the RR mode is entered, as shown in FIG. 27(*c*), the user may set the temperature of the refrigerator compartment 12 by pressing the refrigerator compartment button 322. When the refrigerator compartment button 322 is pressed, the temperature of the refrigerator compartment 12 can be set step by step, and every time the refrigerator compartment button 322 is pressed, the changed set temperatures can be displayed by turning on/off on the display section 31. The convertible compartment 11 is also operated as the refrigerator compartment 12 in the RR mode, and accordingly, the temperature of the convertible compartment 11 can also be maintained at the set temperature displayed on the display section 31.

Further, in order to switch back into the FR mode when the refrigerator 1 is operated in the RR mode, as shown in FIG. 27(*d*), the user presses the convertible compartment button 321 for a set time (for example, 3 seconds). When the convertible compartment button 321 is pressed for the set time, the controller 344 recognizes the switch into the FR mode and makes the refrigerator 1 operate in the FR mode. Further, the portion showing the temperature of the convertible compartment 11 in the display section 31 can be turned back on and the user can set the temperature of the convertible compartment 11 by continuously operating the convertible compartment button 321.

Figure 28:
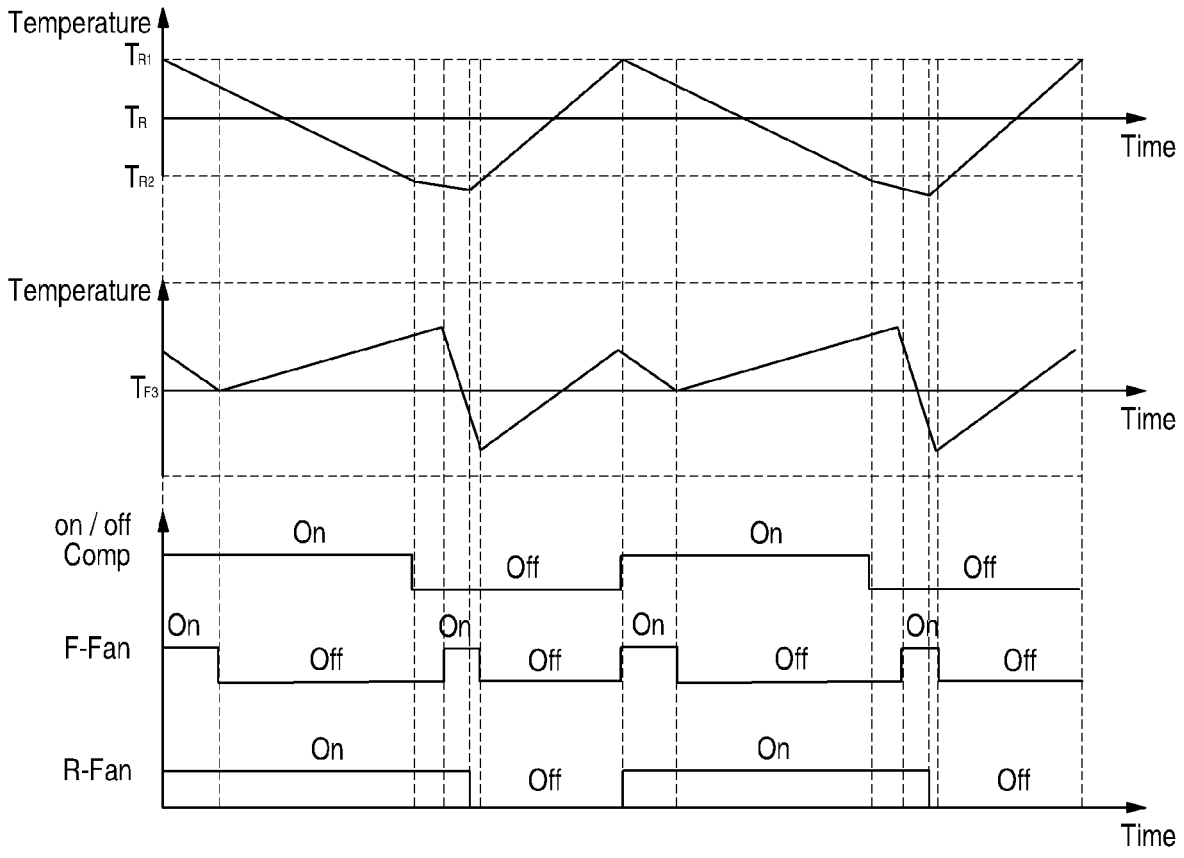
FIG. 28 is a graph showing an operation state of the refrigerator in the RR mode.

FIG. 28 is a graph showing an operation state of the refrigerator in the RR mode.

As shown, when the refrigerator 1 is operated in the RR mode, the compressor 141 can be turned on/off, depending on the temperature of the refrigerator compartment 12 detected by the refrigerator compartment temperature sensor 122. That is, when the temperature of the refrigerator compartment 12 reaches an upper limit temperature Tr1, the compressor 141 is turned on, and when the temperature of the refrigerator compartment 12 reaches a lower limit temperature Tr2, the compressor 141 is turned off.

The refrigerator compartment fan 42 can be turned on together with the compressor 141 when the compressor 141 is turned on. Further, the refrigerator compartment fan 42 can provide additional cooling power by keeping turned on for a set time (for example, 10 minutes) after the compressor 141 is turned off, and then it can be turned off. Accordingly, the temperature of the refrigerator compartment 12 can be maintained between the upper limit temperature Tr1 and the lower limit temperature Tr2.

The convertible compartment fan 41 can be turned on together with the compressor 141 when the compressor 141 is turned on, and is turned off when the temperature of the convertible compartment 11 reaches a setting temperature Tf3 (for example, 5.5° C.). The setting temperature Tf3 may be determined to be the same as or close to the temperature of the refrigerator compartment 12. Since the convertible compartment fan 41 is positioned close to the evaporator 15 and has a relatively short channel, it may operate for a shorter time than the refrigerator compartment fan 42 and may then be turned off.

The convertible compartment fan 41 may additionally operate after the compressor is turned off and a set time passes. The convertible compartment fan 41 may start to additional operate between the point of time when the compressor 141 is turned off and the point of time when the refrigerator compartment fan 42 is turned off. Further, the convertible compartment fan 41 may additionally operate for an additional time after the refrigerator compartment fan 42 is turned off, and then it may be stopped. For example, the convertible compartment fan 41 may be turned on to start additional operation when six minutes has passed after the compressor 141 is turned off, and it may be turned off after operating for one minute after the refrigerator compartment fan 42 is turned off.

The convertible compartment 11 can additionally operate by the additional operation, and accordingly, it may prevent the convertible compartment 11 from being overcooled and remove frost by preventing an excessive increase of the temperature of the convertible compartment 11.

The convertible compartment 11 may operate at an additional refrigerator compartment in the RR mode. In this example, the refrigerator compartment 12 and the convertible compartment 11 are maintained at same or similar temperature, but the refrigerator compartment 12 has a larger capacity than the convertible compartment 11 and the channel from the space where the evaporator 15 is disposed to the refrigerator compartment 12 is relatively long, so it is required to supply a larger amount of cold air in comparison to the refrigerator compartment 12.

Accordingly, the input voltage for the convertible compartment fan 41 may be made higher than the input voltage for the refrigerator compartment fan 42 in the RR mode. That is, a larger amount of cold air may be supplied into the refrigerator compartment 12 by making the number of revolutions of the refrigerator compartment fan 42 larger than that of the convertible compartment fan 41. The refrigerator compartment 12 can be more effectively cooled by adjusting the numbers of revolutions, as described above.

A refrigerator according to an embodiment may include: one evaporator disposed in a convertible compartment; a convertible compartment fan supplying cold air produced by the evaporator into the convertible compartment; a refrigerator compartment fan supplying cold air into a refrigerator compartment; a controller switching an FR mode in which the convertible compartment is maintained at a freezer temperature and an RR mode in which the convertible compartment is maintained at a refrigerator temperature in response to input from a user; and a convertible compartment temperature sensor and a refrigerator compartment temperature sensor. When an instruction to operate the convertible compartment at the refrigerator temperature is input, the controller may turn on a defrost heater with a compressor, the convertible compartment fan, and the refrigerator compartment fan turned off, thereby increasing the temperature of the evaporator.

The defrost heater can keep being turned on for a common defrost operation time.

The defrost heater may keep being turned on until the temperature of the evaporator reaches a setting temperature.

When the defrost heater is turned off, the convertible compartment fan and the refrigerator compartment fan can be simultaneously operated for a setting time so that the air in the convertible compartment and the refrigerator compartment is mixed.

The convertible compartment fan can rotate at a higher speed than the refrigerator compartment fan in the FR mode.

The refrigerator compartment fan can rotate at a higher speed than the convertible compartment fan in the RR mode.

A user can select the FR mode or the RR mode through an operation section and the operation mode selected by the input through the operation section can be display on a display section.

In the RR mode, only the temperature of the refrigerator compartment can be set through the operation section and the setting temperature of the refrigerator compartment can be displayed on the display section.

In the RR mode, the compressor and the refrigerator compartment fan can be turned on and off, depending on the refrigerator compartment temperature sensor.

In the RR mode, the convertible compartment fan can start to additionally operate before the refrigerator compartment fan is turned off, and the additional operation of the convertible compartment fan can be stopped when a-setting time has passed after the refrigerator compartment fan is turned off.

In the FR mode, the compressor and the convertible compartment fan can be turned on and off, depending on the convertible compartment temperature sensor.

In the FR mode, the refrigerator compartment fan can additionally operate for a setting time after the convertible compartment fan is turned off, and then it can be turned off.

An object is to provide a refrigerator in which manufacturing cost can be reduced and an internal capacity can be increased by independently cooling two storage spaces using one evaporator without a damper.

An object is to provide a refrigerator that can cool two independent storage spaces using one evaporator and two fans, and can prevent backflow of air through a channel for a first fan that is not in operation when only a second one fan is operated.

An object is to provide a refrigerator that cools a convertible compartment and a freezer compartment using one evaporator and two fans so that the convertible compartment can be switched and used as a refrigerator compartment and a freezer compartment.

An object is to provide a refrigerator that can smoothly discharge condensate water and defrost water inside and outside a grill pan assembly that divides or separates a space where a convertible compartment and an evaporator are disposed.

An object is to provide a refrigerator that can quickly change temperature to a refrigerator temperature when a convertible compartment that can be switched into a refrigeration compartment and a freezer compartment is used at a freezer temperature.

A refrigerator according to an aspect may include: a cabinet; a refrigerator compartment disposed at a side of the cabinet; a convertible compartment disposed at the other side of the cabinet and being able to be set at a refrigerator temperature or a freezer temperature; an evaporator disposed in the convertible compartment; and a grill pan assembly forming a space where the evaporator is disposed by dividing the inside of the convertible compartment. The grill pan assembly may include: an insulating member having a convertible compartment channel for supplying cold air to the convertible compartment and a refrigerator compartment channel formed at the opposite side to the convertible compartment channel to supply cold air to the refrigerator compartment; a convertible compartment fan disposed at an opening of the convertible compartment channel and forcibly blowing cold air from the evaporator to the convertible compartment channel; a refrigerator compartment fan disposed at an opening of the refrigerator compartment channel and forcibly blowing cold air from the evaporator to the refrigerator compartment channel; and an opening formed through the insulating member from the convertible compartment channel to the refrigerator compartment channel and preventing air in the refrigerator compartment from flowing backward by allowing some of air, which is discharged when the convertible compartment fan is operated, to flow into the refrigerator compartment channel.

The opening may be a negative pressure compensation hole formed at a position corresponding to a refrigerator compartment inlet through which cold air flows inside, to reduce negative pressure that is generated when the refrigerator compartment fan is rotated.

The negative pressure compensation hole may include: be formed in an extension line from a rotational center of the refrigerator compartment fan.

The negative pressure compensation hole has: an inlet that is open to the convertible compartment channel and is inclined at an angle to guide air that flows inside; and an extension that extends from the end of the inlet to the refrigerator compartment channel to guide air flowing inside to the refrigerator compartment channel.

The convertible compartment channel and the refrigerator compartment channel are arranged in parallel at both sides of the center portion of the grill assembly.

A dividing wall vertically extending in an inflow direction of air to separate the convertible compartment fan and the refrigerator compartment fan may be further formed between the convertible compartment fan and the refrigerator compartment fan.

The opening may be an anti-backflow portion that is open to the refrigerator compartment channel at a side of the convertible compartment channel, and may block air flowing backward from the refrigerator compartment by allowing some of air discharged from the convertible compartment fan to flow to the refrigerator compartment.

The anti-backflow portion may extend in a same direction as the extension direction of the refrigerator compartment channel.

The anti-backflow portion may be positioned at an angle in the rotational direction of the convertible compartment fan.

The anti-backflow portion may be open in the flow direction of air by rotation of the refrigerator compartment fan.

The anti-backflow portion may include: an inlet guide recessed at an angle at the convertible compartment channel; an outlet guide recessed at an angle at the refrigerator compartment channel; and a through-portion connecting the inlet guide and the outlet guide.

The outlet guide may increase in width as it goes away from the through-portion.

The convertible compartment channel may be recessed inward, and the outlet guide may be formed at a stepped end of the convertible compartment channel.

The opening may include: a negative pressure compensation hole formed at a position corresponding to a refrigerator compartment inlet through which cold air flows inside, to reduce negative pressure that is generated when the refrigerator compartment fan is rotated; and an anti-backflow portion that is open to the refrigerator compartment channel at a side of the convertible compartment channel and blocks air flowing backward from the refrigerator compartment by allowing some of air discharged from the convertible compartment fan to flow to the refrigerator compartment.

The negative pressure compensation hole and the anti-backflow portion are arranged in the rotational direction of the convertible compartment fan.

The anti-backflow portion may be formed further away from the convertible compartment channel than the negative pressure compensation hole.

The grill pan assembly may further include: a grill pan forming the front side of the grill pan assembly and forming a portion of inner sides of the convertible compartment; and an insulating sheet disposed in a plate shape between the grill pan and the insulating member and insulating the convertible compartment channel and the grill pan from each other.

The grill pan may include: upper pan exits formed at the upper portion of the grill pan to discharge cold air in the convertible compartment channel to the convertible compartment; and lower pan exits formed under the upper pan exits and having a smaller area than the upper pan exits.

The convertible compartment channel may be recessed and may include: an upper section having a width enough for receiving the upper pan exits and the convertible compartment fan; and a lower section having a width enough for receiving the lower pan exits, and the upper section may decrease in width as it goes to the upper end of the lower section.

The grill pan assembly may further include an insulating duct mounted in the recessed refrigerator compartment channel on the insulating member and forming an independent channel for cold air to flow to the refrigerator compartment.

The insulating duct may include: a lower part extending upward from the lower end of the grill pan assembly; and an upper part extending at an angle from the upper end of the lower part to the refrigerator compartment fan.

The width of the lower part may be smaller than the width of the upper part, and the depth of the lower part may be larger than the depth of the upper part.

The cross-sectional areas of the lower part and the upper part may be the same.

The lower part may be disposed at an end of the insulating member and a recessed evaporator seat for receiving the evaporator may be formed at the lower portion of the insulating member.

The grill pan assembly may further include: a grill pan forming the front external appearance of the grill pan assembly; and a shroud forming the rear external appearance of the grill pan assembly and combined with the grill pan with the insulating member therebetween.

The shroud may have a convertible compartment fan mount and a refrigerator compartment fan mount in which the convertible compartment fan and the refrigerator compartment fan are mounted, respectively.

The convertible compartment fan and the refrigerator compartment fan are box fans having the same size and shape, and the convertible compartment fan mount and the refrigerator compartment fan mount have an open rectangular shape.

A dividing wall extending between the convertible compartment fan mount and the refrigerator compartment fan mount is formed on the shroud, and the convertible compartment fan mount and the refrigerator compartment fan mount are arranged at both sides of the dividing wall.

Seats that support the convertible compartment fan and the refrigerator compartment fan such that the upper ends of the convertible compartment fan and the refrigerator compartment fan further protrude are formed at an angle in the convertible compartment fan mount and the refrigerator compartment fan mount.

Inclined portions that are inclined toward the center may be formed at both sides of the lower end of the recessed convertible compartment channel, a water discharge hole may be formed through the insulating member at the joint of the inclined portions at both sides, and a first water discharge guide may be recessed on the rear side of the insulating member and may extend from the water discharge hole to the lower end of the insulating member to discharge water in the convertible compartment channel.

The refrigerator may further include an insulating duct forming an independent cold air channel toward the refrigerator compartment by being fitted in the refrigerator compartment channel, in which the insulating member may have a second water discharge guide having an end that communicates with the insulating duct and the other end that extends to the lower end of the insulating member to discharge water in the insulating duct.

The convertible compartment fan and the refrigerator compartment fan may be mounted at an angle such that the upper ends protrude further than the rear side of the grill pan assembly.

The convertible compartment fan and the refrigerator compartment fan may be box fans, and the convertible compartment fan and the refrigerator compartment fan may be arranged to be inclined in the opposite directions to the rotational directions of blades of the convertible compartment fan and the refrigerator compartment fan.

According to the refrigerator according to an aspect of the present disclosure, the following effects may be expected.

Since the refrigerator has a structure that can supply cold air into the convertible compartment and the refrigerator compartment even without using a damper, manufacturing costs may be reduced and productivity may be improved. Further, since a relatively large damper is not used, the effect of increasing an internal capacity of the refrigerator may be expected.

Since air can flow through the negative pressure compensation hole when only the convertible compartment fan is operated, even though there is no damper, the air in the refrigerator compartment may be prevented from flowing backward by removing negative pressure.

Air that flows backward from the refrigerator compartment may be blocked by supplying some of air blown by the convertible compartment fan to the refrigerator compartment channel when only the convertible compartment fan is operated. That is, air in the refrigerator compartment may be prevented from flowing inside in two steps (or two operations) with the negative pressure compensation hole, so it is possible expect the effect of more effectively preventing backflow of the air in the refrigerator compartment.

By preventing backflow of the air in the refrigerator, as described above, an increase of the temperature of the convertible compartment may be prevented and frosting and freezing may be prevented at the evaporator, the convertible compartment, the refrigerator compartment fan, and the channels connected to them due to high-humidity air in the refrigerator compartment.

When a user sets the convertible compartment at a refrigerator temperature to use the convertible compartment as an additional refrigerator compartment, the temperature of the convertible compartment may be quickly increased by increasing the temperature of the evaporator through an additional defrost operation in response to the input from the user.

The air in the convertible compartment and the refrigerator compartment may be mixed by operating both of the convertible compartment fan and the refrigerator compartment fan with the compressor stopped after the defrost operation stopped. Accordingly, the temperature of the convertible compartment may be quickly increased. Since the temperature of the convertible compartment can quickly reach the refrigerator temperature, it is possible to expect the effect of considerably improving convenience in use.

Since the refrigerator has a structure that can switch the operation mode of the convertible compartment, a defrost operation may be necessary. Additionally, since the first water discharge guide and the second water discharge guide are provided, defrost water may be effectively discharged in a defrost operation.

Since the convertible compartment fan and the refrigerator compartment fans are box fan and mounted at an angle in the opposite direction to the rotational direction of the fans, defrost water may easily flow down without collecting.

Since the convertible compartment fan and the refrigerator compartment fan are mounted at an angle such that the upper ends further protrude than the rear side of the grill pan assembly, defrost water may more easily flow down.

Since the duct water exit connected to the second water discharge guide is formed at a side of the insulating duct, defrost water in a channel can be effectively discharged.

Other aspects, features and advantages may also be provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet;

a refrigerator compartment disposed at the cabinet;

a convertible compartment disposed at the cabinet, and the convertible compartment to be capable of being set at a refrigerator temperature or a freezer temperature;

an evaporator disposed in the convertible compartment; and a grill pan assembly disposed inside of the convertible compartment;

wherein the grill pan assembly includes:

an insulating structure having a convertible compartment channel and a refrigerator compartment channel, the convertible compartment channel at a first side of the insulating structure to supply cold air to the convertible compartment, and the refrigerator compartment channel at a second side of the insulating structure to supply cold air to the refrigerator compartment;

a convertible compartment fan at the convertible compartment channel, and the convertible compartment fan to provide cold air from the evaporator to the convertible compartment channel; and a refrigerator compartment fan at the refrigerator compartment channel, and the refrigerator compartment fan to provide cold air from the evaporator to the refrigerator compartment channel, wherein the grill pan assembly further includes:

a grill pan to form a front surface of the grill pan assembly, an insulating sheet disposed between the grill pan and the insulating structure, and the insulating sheet to insulate the convertible compartment channel from the grill pan, an insulating duct disposed in the refrigerator compartment channel at the insulating structure, and the insulating duct to allow air to flow toward the refrigerator compartment, and a shroud to form a rear surface of the grill pan assembly, and the shroud to couple with the grill pan, wherein the insulating structure is disposed between the shroud and the grill pan, and wherein the insulating structure includes at least one air guide opening from the convertible compartment channel to the refrigerator compartment channel, the at least one air guide opening to allow some air to flow into the refrigerator compartment channel when the convertible compartment fan is to operate, and to block some air from flowing backward from the refrigerator compartment to a space of the evaporator.

2. The refrigerator of claim 1, wherein the at least one air guide opening includes a negative pressure compensation hole at a refrigerator compartment inlet at the insulating structure, wherein the negative pressure compensation hole to reduce negative pressure when the refrigerator compartment fan is to rotate.

3. The refrigerator of claim 2, wherein the negative pressure compensation hole is provided at the insulating structure along an extension line from a rotational center of the refrigerator compartment fan.

4. The refrigerator of claim 1, wherein the convertible compartment fan and the refrigerator compartment fan are arranged in parallel, and a dividing wall provided between the convertible compartment fan and the refrigerator compartment fan to separate the convertible compartment fan and the refrigerator compartment fan.

5. The refrigerator of claim 1, wherein the at least one air guide opening includes an anti-backflow portion that is open to the refrigerator compartment channel at a side of the convertible compartment channel, and the anti-backflow portion to allow the some air from the convertible compartment fan to flow toward the refrigerator compartment and block air from flowing backward from the refrigerator compartment.

6. The refrigerator of claim 5, wherein the anti-backflow portion includes:

an inlet guide recessed at an angle at the convertible compartment channel;

an outlet guide recessed at an angle at the refrigerator compartment channel; and a through-portion to connect the inlet guide and the outlet guide.

7. The refrigerator of claim 6, wherein the outlet guide increases in width as the outlet guide extends away from the through-portion.

8. The refrigerator of claim 6, wherein the outlet guide is provided at a stepped end of the convertible compartment channel.

9. The refrigerator of claim 1, wherein the at least one air guide opening includes:

a negative pressure compensation hole to reduce negative pressure when the refrigerator compartment fan is to rotate; and an anti-backflow portion that is open to the refrigerator compartment channel at a side of the convertible compartment channel, and the anti-backflow portion to allow some air from the convertible compartment fan to flow toward the refrigerator compartment and block some air from flowing backward from the refrigerator compartment.

10. The refrigerator of claim 1, wherein the grill pan includes:

upper pan exits at an upper portion of the grill pan to discharge air in the convertible compartment channel to the convertible compartment; and lower pan exits under the upper pan exits, and the lower pan exits having a smaller area than the upper pan exits.

11. The refrigerator of claim 10, wherein the convertible compartment channel includes:

an upper section to receive the upper pan exits of the grill pan and the convertible compartment fan; and a lower section to receive the lower pan exits of the grill pan, and wherein the upper section decreases in width as the upper section extends to the upper end of the lower section.

12. The refrigerator of claim 1, wherein the insulating duct includes:

a lower part to extend upward from a lower end of the grill pan assembly; and an upper part to extend at an angle from an upper end of the lower part to the refrigerator compartment fan.

13. The refrigerator of claim 12, wherein a width of the lower part of the insulating duct is less than a width of the upper part of the insulating duct, a depth of the lower part is larger than a depth of the upper part, and a cross-sectional area of the lower part is same as a cross-sectional area of the upper part.

14. The refrigerator of claim 1, wherein the insulating structure includes:

inclined portions that are inclined toward a center of a lower end of the convertible compartment channel;

a water discharge hole at a joining of the inclined portions of the convertible compartment channel, and a first water discharge guide at the first side of the insulating structure, wherein the first water discharge guide to extend from the water discharge hole to a lower end of the insulating structure to discharge water in the convertible compartment channel.

15. The refrigerator of claim 14, further comprising an insulating duct that extends from the refrigerator compartment channel toward the refrigerator compartment, wherein the insulating structure includes a second water discharge guide having a first end to communicate with the insulating duct and a second end that extends to the lower end of the insulating structure to discharge water into the insulating duct.

16. The refrigerator of claim 14, wherein the convertible compartment fan is a box fan, and the refrigerator compartment fan is a box fan, the convertible compartment fan is provided at an angle such that an upper end of the convertible compartment fan to protrude further than a rear side of the grill pan assembly, wherein the convertible compartment fan is inclined in an opposite direction to a rotational direction of blades of the convertible compartment fan, the refrigerator compartment fan is provided at an angle such that an upper end of the refrigerator compartment fan to protrude further than a rear side of the grill pan assembly, wherein the refrigerator compartment fan is inclined in an opposite direction to a rotational direction of blades of the refrigerator compartment fan.

17. A refrigerator comprising:

a refrigerator compartment;

a convertible compartment;

an evaporator at the convertible compartment; and a grill pan assembly at the convertible compartment, wherein the grill pan assembly includes:

an insulating structure having a convertible compartment channel and a refrigerator compartment channel, the convertible compartment channel at a first side of the insulating structure, and the refrigerator compartment channel at a second side of the insulating structure;

a convertible compartment fan at the convertible compartment channel to provide air to the convertible compartment channel; and a refrigerator compartment fan at the refrigerator compartment channel to provide air to the refrigerator compartment channel, wherein the insulating structure includes at least one air guide opening to prevent air in the refrigerator compartment from flowing to the refrigerator compartment channel when the convertible compartment fan is to operate, wherein the grill pan assembly further includes a grill pan to form a front surface of the grill pan assembly, and wherein the grill pan includes:

upper pan exits at an upper portion of the grill pan to discharge air in the convertible compartment channel to the convertible compartment; and lower pan exits under the upper pan exits, and the lower pan exits having a smaller area than the upper pan exits.

18. The refrigerator of claim 17, wherein the least one air guide opening includes a negative pressure compensation hole to reduce negative pressure when the refrigerator compartment fan is to operate.

19. The refrigerator of claim 17, wherein the at least one air guide opening includes an anti-backflow portion to allow air from the convertible compartment fan to flow toward the refrigerator compartment and block air from flowing backward from the refrigerator compartment to a space of the evaporator.

20. The refrigerator of claim 17, wherein the at least one air guide opening includes:

a negative pressure compensation hole at a refrigerator compartment inlet to reduce negative pressure when the refrigerator compartment fan is to operate; and an anti-backflow portion to allow air from the convertible compartment fan to flow toward the refrigerator compartment and block air from flowing back from the refrigerator compartment to a space of the evaporator.

21. The refrigerator of claim 17, wherein the grill pan assembly includes an insulating duct at the refrigerator compartment channel at the insulating structure, and the insulating duct to allow air to flow toward the refrigerator compartment.

22. The refrigerator of claim 17, wherein the insulating structure includes:

inclined portions that are inclined toward a center of a lower end of the convertible compartment channel;

a water discharge hole at a joining of the inclined portions of the convertible compartment channel; and a first water discharge guide of the first side of the insulating structure, wherein the first water discharge guide to extend from the water discharge hole to the lower end of the insulating member to discharge water in the convertible compartment channel.

23. The refrigerator of claim 22, further comprising an insulating duct that extends from the refrigerator compartment channel toward the refrigerator compartment, wherein the insulating structure includes a second water discharge guide having a first end to communicate with the insulating duct and a second end that extends to the lower end of the insulating structure to discharge water into the insulating duct.

24. A grill pan assembly to be provided in a compartment, comprising:

an insulating structure having a convertible compartment channel and a refrigerator compartment channel, wherein the convertible compartment channel at a first side of the insulating structure is configured to supply air to a convertible compartment, and the refrigerator compartment channel at a second side of the insulating structure is configured to supply air to a refrigerator compartment;

a convertible compartment fan disposed at the convertible compartment channel, and configured to provide air from an evaporator to the convertible compartment channel; and a refrigerator compartment fan disposed at the refrigerator compartment channel, and configured to provide air from the evaporator to the refrigerator compartment channel, wherein the insulating structure includes at least one air guide opening to allow some air to flow into the refrigerator compartment channel when the convertible compartment fan is to operate, and to block some air in the refrigerator compartment from flowing backward, wherein the grill pan assembly further includes an insulating duct that is disposed in the refrigerator compartment channel at the insulating structure, and the insulating duct to allow air to flow toward the refrigerator compartment, and wherein the insulating duct includes:

a lower part to extend upward from a lower end of the grill pan assembly; and an upper part to extend at an angle from an upper end of the lower part to the refrigerator compartment fan.

25. The grill pan assembly of claim 24, wherein the at least one air guide opening includes a negative pressure compensation hole at a refrigerator compartment inlet to reduce negative pressure when the refrigerator compartment fan is to operate.

26. The grill pan assembly of claim 24, wherein the at least one air guide opening includes an anti-backflow portion to allow air from the convertible compartment fan to flow toward the refrigerator compartment and block air from flowing backward from the refrigerator compartment.

27. A refrigerator comprising:

a cabinet;

a refrigerator compartment at the cabinet;

a convertible compartment at the cabinet;

the evaporator in the convertible compartment; and the grill pan assembly of claim 24, wherein the grill pan assembly is at the convertible compartment.

* * * * *